US005238235A

United States Patent [19]

Nitta et al.

[11] Patent Number: 5,238,235

[45] Date of Patent: Aug. 24, 1993

[54] SHEET FEEDING APPARATUS

[75] Inventors: Tetsuhiro Nitta, Yokohama; Takehiko Kiyohara, Zama; Yasuhiro Unosawa, Tokyo; Shigeru Yoshimura, Yokohama, all of Japan

[73] Assignee: Canon Kabushiki Kaisha, Tokyo, Japan

[21] Appl. No.: 742,621

[22] Filed: Aug. 7, 1991

[30] Foreign Application Priority Data

| | | | |
|---|---|---|---|
| Aug. 10, 1990 | [JP] | Japan | 2-212514 |
| Aug. 10, 1990 | [JP] | Japan | 2-212515 |
| Aug. 10, 1990 | [JP] | Japan | 2-212516 |
| Aug. 10, 1990 | [JP] | Japan | 2-212517 |
| Aug. 10, 1990 | [JP] | Japan | 2-212518 |
| Aug. 10, 1990 | [JP] | Japan | 2-212519 |
| Aug. 10, 1990 | [JP] | Japan | 2-212520 |

[51] Int. Cl.[5] ..... B65H 3/44

[52] U.S. Cl. ..... 271/9; 271/127; 271/162; 271/264; 271/270; 400/629

[58] Field of Search ..... 271/9, 149, 162, 225, 271/264, 270, 126, 127; 400/624, 629

[56] References Cited

U.S. PATENT DOCUMENTS

| | | | |
|---|---|---|---|
| 3,687,448 | 8/1972 | Vora | 271/161 X |
| 4,113,244 | 9/1978 | Ruenzi | 271/270 |
| 4,313,124 | 1/1982 | Hara | 346/140 R |
| 4,319,790 | 3/1982 | Ulseth | 271/162 X |
| 4,337,935 | 7/1982 | Sawada et al. | 271/9 |
| 4,345,262 | 8/1982 | Shirato et al. | 346/140 R |
| 4,455,081 | 6/1984 | Yoshimura et al. . | |
| 4,459,600 | 7/1984 | Sato et al. | 346/140 R |
| 4,463,359 | 7/1984 | Ayata et al. | 346/1.1 |
| 4,470,796 | 4/1988 | Endo et al. | 346/1.1 |
| 4,558,333 | 12/1985 | Sugitani et al. | 346/140 R |
| 4,723,129 | 2/1988 | Endo et al. | 346/1.1 |
| 4,786,920 | 11/1988 | Igarashi | 271/9 X |
| 5,052,670 | 10/1991 | Makiura et al. | 271/9 |

FOREIGN PATENT DOCUMENTS

| | | | |
|---|---|---|---|
| 54-056847 | 5/1979 | Japan . | |
| 224948 | 12/1983 | Japan | 271/264 |
| 59-123670 | 7/1984 | Japan . | |
| 59-138461 | 8/1984 | Japan . | |
| 203018 | 11/1984 | Japan | 271/149 |
| 6540 | 1/1985 | Japan | 271/9 |
| 60-071260 | 4/1985 | Japan . | |
| 229733 | 10/1986 | Japan | 271/9 |
| 277533 | 12/1986 | Japan | 271/9 |
| 28444 | 1/1990 | Japan | 271/9 |
| 2068907 | 8/1981 | United Kingdom | 271/9 |
| 2216501 | 10/1989 | United Kingdom | 271/9 |

*Primary Examiner*—Robert P. Olszewski
*Assistant Examiner*—Boris Milef
*Attorney, Agent, or Firm*—Fitzpatrick, Cella, Harper & Scinto

[57] ABSTRACT

A sheet feeding apparatus includes a sheet containing device for supporting sheets, a sheet supply device for feeding out the sheet from the sheet containing device, and a path surface for deflecting the sheet by abutting the sheet fed from the sheet supply device against the path surface to guide the sheet in a predetermined direction. In such sheet feeding apparatus, a rotary feeding device for applying a feeding force to the sheet by slidingly contacting with a surface of the sheet fed from the sheet supply device, which is opposite to a surface facing the path surface, is provided.

27 Claims, 26 Drawing Sheets

SHEET FEEDING APPARATUS

BACKGROUND OF THE INVENTION

1. Field of the Invention

The present invention relates to a sheet feeding apparatus for automatically supplying recording sheets to a recording station of a recording system one by one.

2. Related Background Art

Recording systems such as printers, copying machines, facsimiles and the like are so designed that an image consisting of a dot pattern is formed on a recording sheet such as a paper, plastic film and the like by energizing energy generating bodies of a recording head in response to image information sent to the system.

Such recording systems can be grouped into ink jet recording systems wire dot recording systems thermal recording systems laser beam recording systems and the like, in accordance with a recording principle.

Further, the recording sheets used with the recording system include a thicker sheet such as a post card, envelope, and a special sheet such as a plastic film, other than a plain paper. The recording sheets can be manually supplied one by one or automatically and continuously supplied by an automatic sheet supplying apparatus.

The automatic sheet supplying apparatus generally comprises a sheet supply drive portion for feeding a recording sheet by rotating a sheet supply roller, and a sheet supply cassette portion in which the recording sheets are stacked. By driving the sheet supply roller by a driving force from a recording sheet feeding mechanism of the recording system, the sheets are separated and supplied one by one.

Further, the automatic sheet supplying apparatus can be grouped into an integrated type wherein the apparatus is incorporated into the recording system and a removable type wherein the apparatus is removably mounted on the recording system. The present invention can be applied to both types. In addition, the automatic sheet supplying apparatus of this kind is also provided with a sheet path surface for guiding the sheet supplied from the sheet supply cassette to the recording station.

The sheet path surface sometimes acts as a manual sheet supply surface, too. Further, the sheet path surface is normally inclined with respect to an advancing direction of the sheet supplied from the sheet supply cassette, so as to make the apparatus compact. The inclined angle of the sheet path surface is sometimes relatively great (for example, about 60 degrees) for the compactness of the apparatus.

With this arrangement, when a guide for guiding the sheet is arranged at a junction between a sheet path for the automatic sheet supply and a sheet path for the manual sheet supply, since the automatically supplied sheet is bent by the guide, the friction between the guide and the sheet is increased, thus increasing the back tension to the sheet (resistance in the sheet feeding direction). Consequently, the feeding of the sheet is unstable, resulting in a discrepancy in the image on the sheet at the recording station, thus reducing the image quality.

SUMMARY OF THE INVENTION

An object of the present invention is to provide a sheet feeding apparatus which can effectively reduce the back tension to a sheet during automatic sheet supply to stabilize the feeding of the sheet during the recording, thereby obtaining an image with high quality and without any discrepancy.

In order to achieve the above object, the present invention provides a sheet feeding apparatus comprising a sheet containing means for supporting sheets, a sheet supply means for feeding out the sheet from the sheet containing means, a path surface for deflecting the sheet by abutting the sheet against it to guide the sheet in a predetermined direction, and a rotary feeding means for applying a feeding force to the sheet by slidingly contacting with a surface of the sheet fed from the sheet supply means, which is opposite to a surface facing the path surface.

With this arrangement, in place of the guide, since the rotary feeding means slidingly contacts with the automatically fed sheet to apply the feeding force to the sheet, it is possible reduce the back tension to the sheet.

Further, since the rotary feeding means slidingly contacts with the sheet to apply the feeding force to the latter, when the whole rotary feeding means or a portion thereof which slidingly contacts with the sheet is made of material having a relatively high coefficient of friction, it is possible to apply the greater feeding force to the sheet.

Further, another object of the present invention is to provide a sheet feeding apparatus which can used for performing both the automatic sheet supply and the manual sheet supply. In order to achieve this object, the sheet feeding apparatus according to the present invention comprises a sheet containing means for supporting sheets, a sheet supply means for feeding out the sheet from the sheet containing means, a path surface for deflecting the sheet by abutting the sheet against it to guide the sheet in a predetermined direction, a manual sheet supply means for manually supplying a sheet along the path surface, and a rotary feeding means for applying a feeding force to the sheet fed from the sheet supply means by slidingly contacting with a surface of the sheet which is opposite to a surface facing the path surface.

With this arrangement, the automatically supplied sheet is fed by the rotary feeding means with reduced back tension thereto, and the manually supplied sheet is fed while being guided between the path surface and the rotary feeding means. That is to say, the rotary feeding means acts to apply a feeding force to the sheet supplied from the sheet containing means and to guide the sheet supplied from the manual sheet supply means.

DETAILED DESCRIPTION OF THE PREFERRED EMBODIMENTS

The present invention will now be explained with reference to the accompanying drawings.

Figure 4:
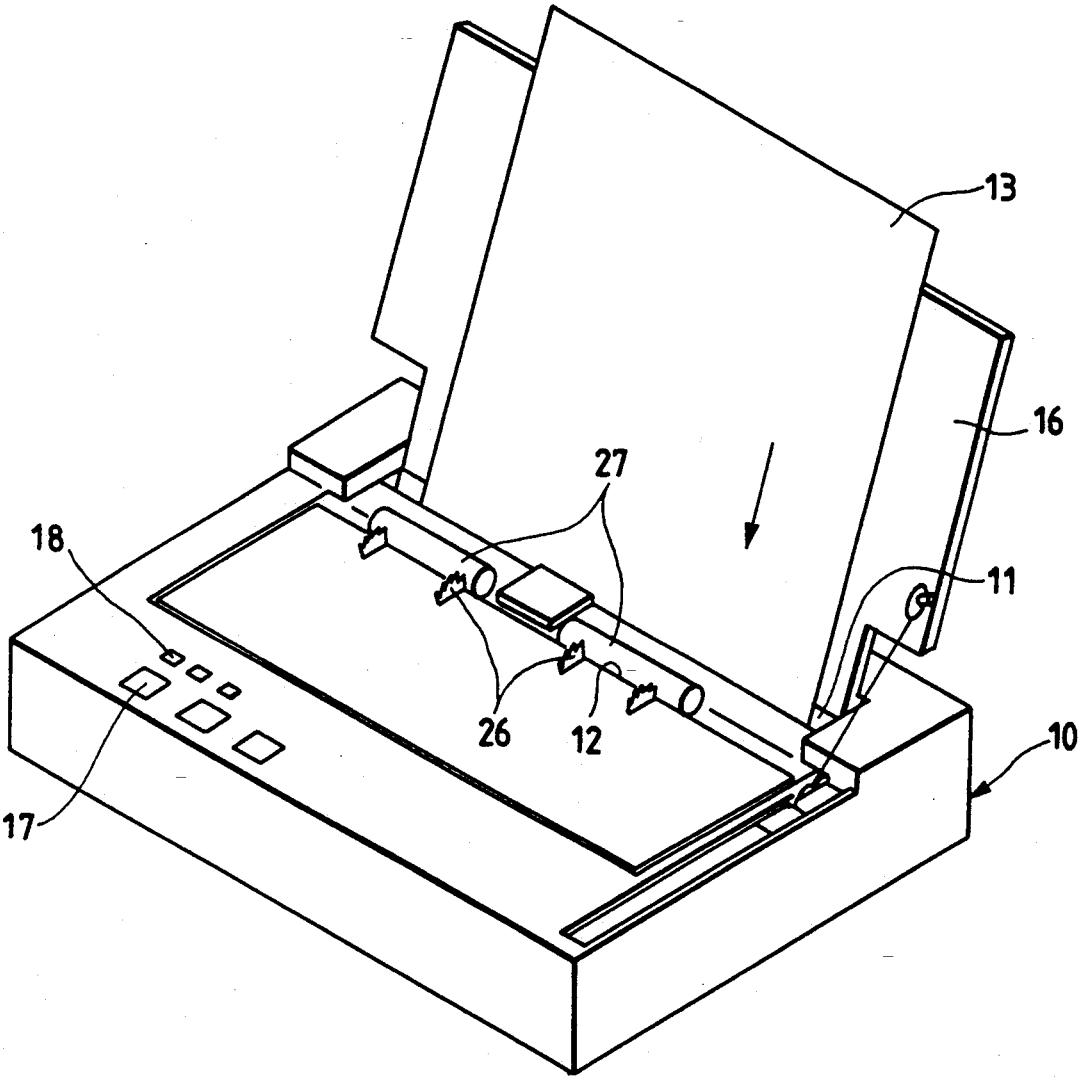
FIG. 4 is a schematic perspective view of the recording system of FIG. 1 showing a condition that it is used in a laid position.
Figure 5:
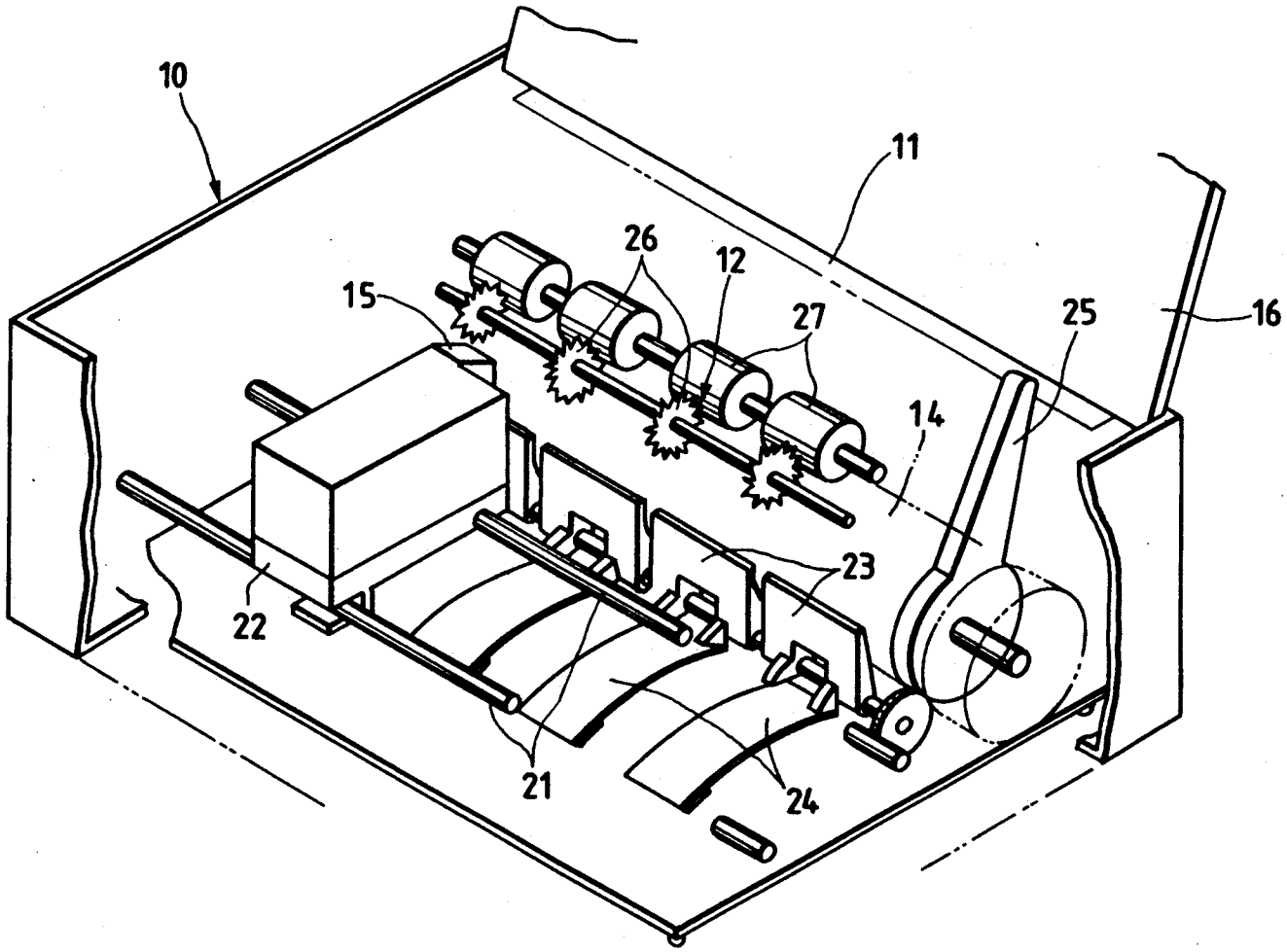
FIG. 5 is a perspective view, partially in section, of the recording system of FIG. 4 for showing the internal construction thereof.

FIG. 4 is a schematic perspective view of a recording system 10 showing a condition that it is used in a laid position, which recording system is suitable to use with a sheet feeding apparatus according to the present invention, and FIG. 5 is a perspective view of the recording system of FIG. 4 for showing the internal construction thereof.

In FIGS. 4 and 5, a recording sheet introduction opening 11 and a recording sheet ejection opening 12 are formed in an upper surface of the recording system (for example, an ink jet recording system for performing a recording operation by discharging ink, taking advantage of thermal energy) 10. A recording sheet 13 introduced into the introduction opening 11 is directed around a platen roller 14 also acting as a feed roller, and then is fed along a U-shaped recording sheet feeding path, and then is passed through a recording station (facing a recording head 15), where an image is formed on the sheet. Thereafter, the recording sheet is ejected upwardly from the ejection opening 12.

Figure 3:
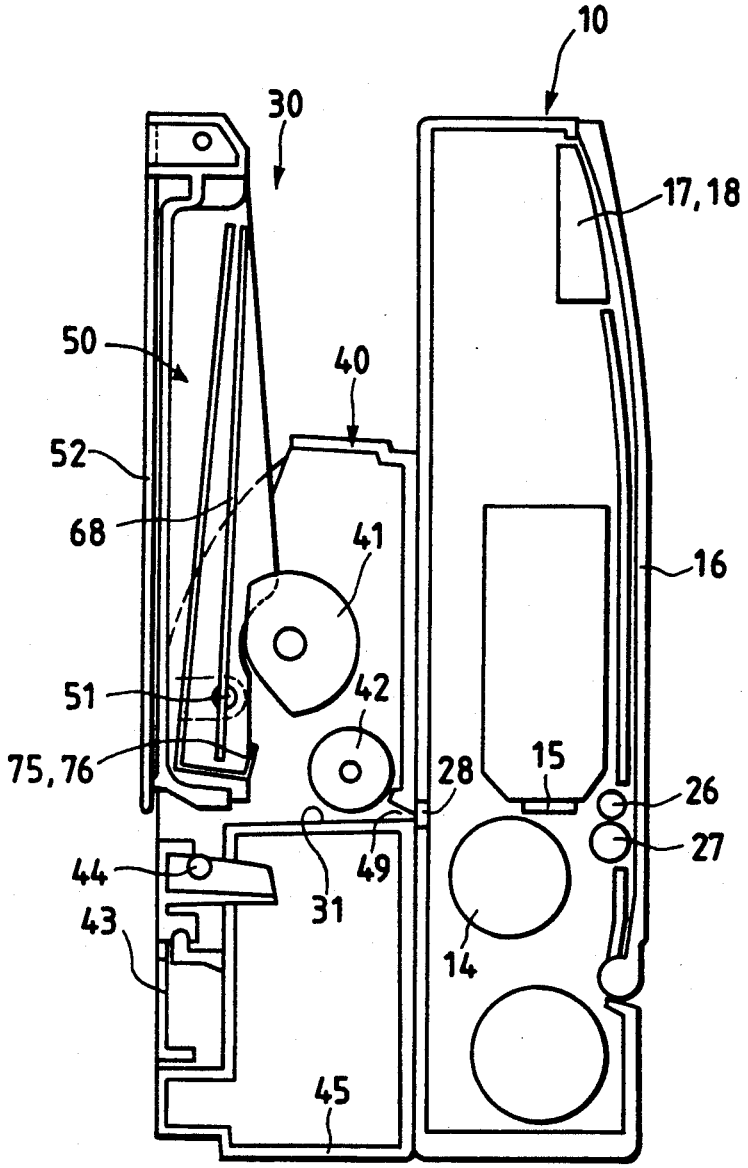
FIG. 3 is a view similar to FIG. 1, but showing a non-sheet supplying condition.

A sheet ejection tray 16 is pivotally connected to the upper surface of the recording system 10 so that is can be opened and closed with respect to the system. In an operative condition (during the recording operation), the ejection tray 16 is opened to act as the sheet ejection tray; whereas, in an inoperative condition (preserved condition and the like), as shown in FIG. 3, the ejection tray is closed to act as a cover 16 for covering and protecting the upper surface of the recording system where the sheet introduction opening 11, sheet ejection opening 12, switches 17 and display 18 are arranged.

In FIG. 5, the recording head 15 is mounted on a carriage reciprocally shifted along guides 21 disposed parallelly with the feed roller (platen roller) 14. Incidentally, the recording head 15 is shown as an ink jet recording head, and thus, is integrally formed with an ink tank. The ink jet recording head 15 is of the type wherein ink is discharged by utilizing thermal energy.

To this end, the recording head is provided with electrical/thermal converters for generating the thermal energy.

Further, the recording head 15 serves to perform the recording operation by discharging the ink from discharge openings by utilizing the change in pressure caused by growth and contraction of bubbles due to the film boiling generated by the thermal energy applied by the selected electrical/thermal converters.

At an upstream side of the recording head 15 in a sheet feeding direction, there are disposed hold-down plates 23 for urging the recording sheet 13 against the feed roller 14. Each hold-down plate 23 is pressed against a peripheral surface of the feed roller 14 by means of a corresponding leaf spring 24. Further, the urging forces of the hold-down plates 23 can be released by manipulating a lever 25 mounted on a roller shaft of the feed roller 14.

In addition, spurs 26 and rollers 27 for aiding the ejection of the recording sheet 13 are arranged in association with the sheet ejection opening 12.

Figure 6:
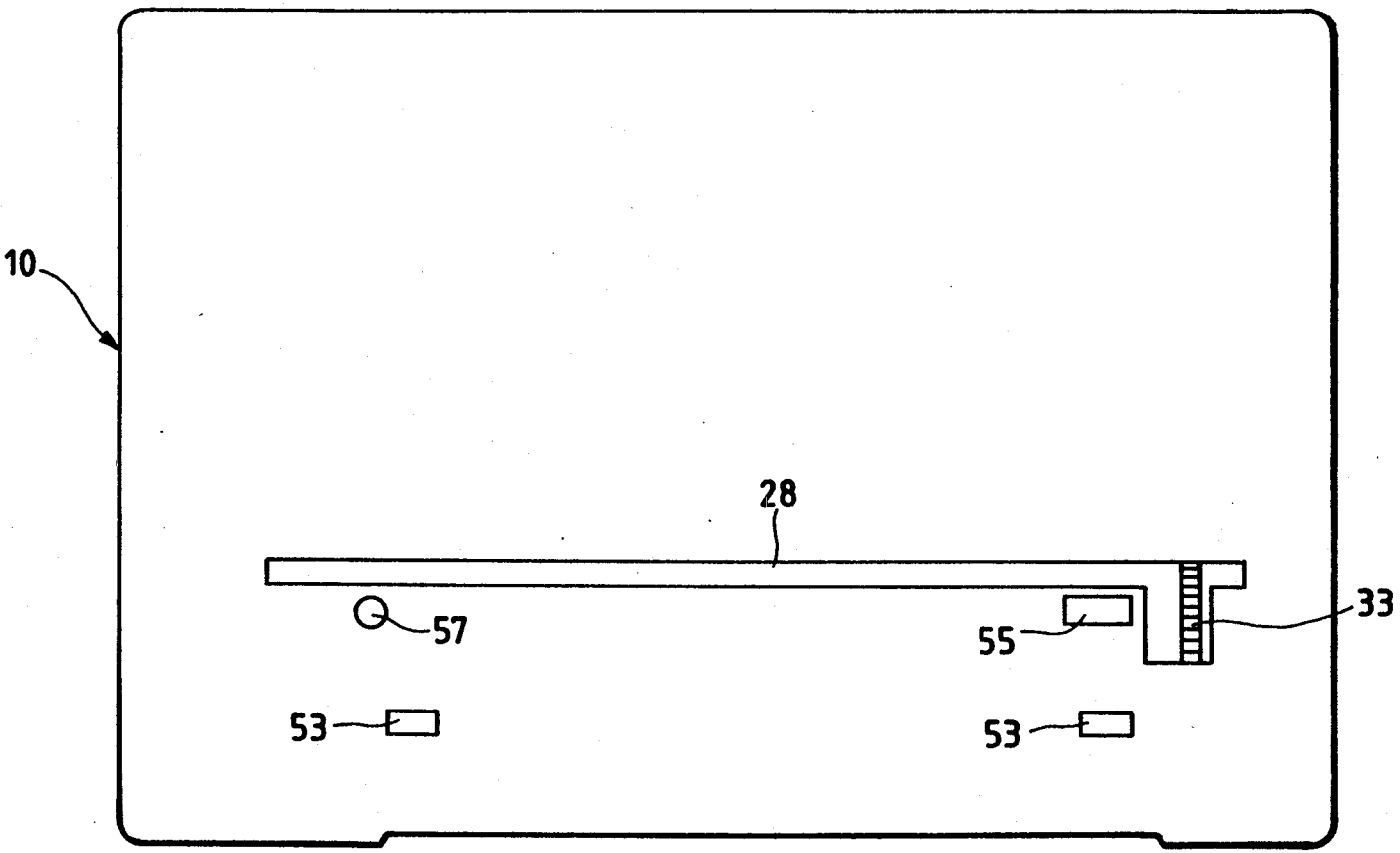
FIG. 6 is a schematic bottom view of the recording system of FIG. 4.

FIG. 6 shows a bottom of the recording system (body frame) 10 (which acts as a rear surface on which the sheet feeding apparatus is mounted, in a cocked condition, as will be described later).

Figure 1:
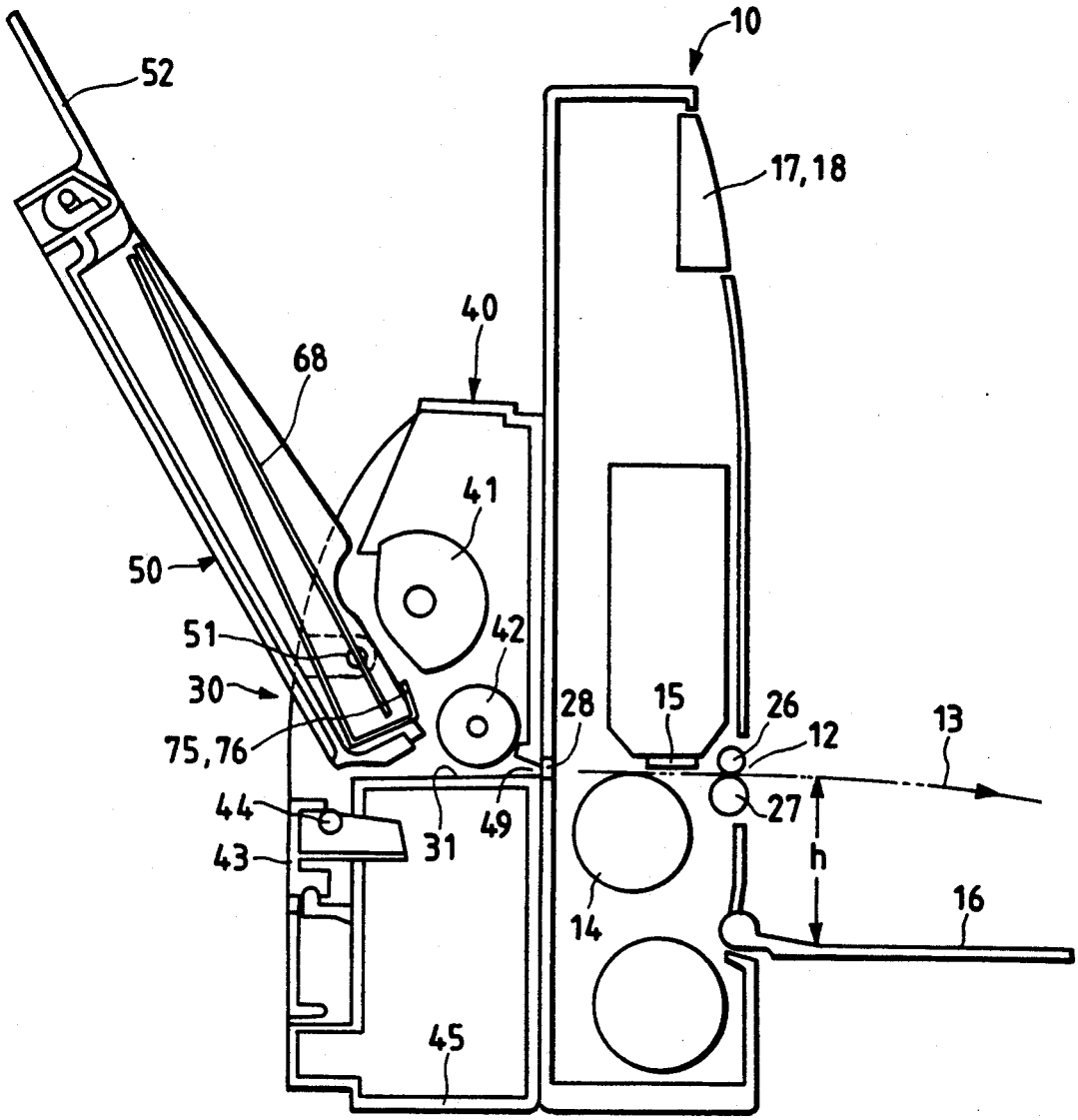
FIG. 1 is a schematic elevational sectional view of a recording system on which a sheet feeding apparatus according to a preferred embodiment of the present invention is mounted, in an automatic sheet supplying condition.

A second sheet introduction opening 28 is formed in the bottom surface of the recording system 10, and a second substantially straight recording sheet feeding path extends in a substantially vertical direction (substantially in a horizontal direction in the cocked position as shown in FIG. 1) from the ejection opening 28 to the sheet ejection opening 12 through the recording station between the recording head 15 and the feed roller 14.

The second sheet feeding path can be used when the recording system is cocked (FIGS. 1 and 2) as will be described later. In this case, since the second sheet feeding path is not curved, it can easily feed any special sheet having the greater resiliency such as a thicker sheet (for example, post card, envelope and the like) or plastic sheet.

The recording system 10 can also be used in the cocked condition. In this cocked condition, the sheet feeding apparatus can be removably mounted thereon. In this case, the recording sheet can be supplied automatically and manually from the sheet introduction opening 28 formed on the bottom surface of the recording system.

Figure 2:
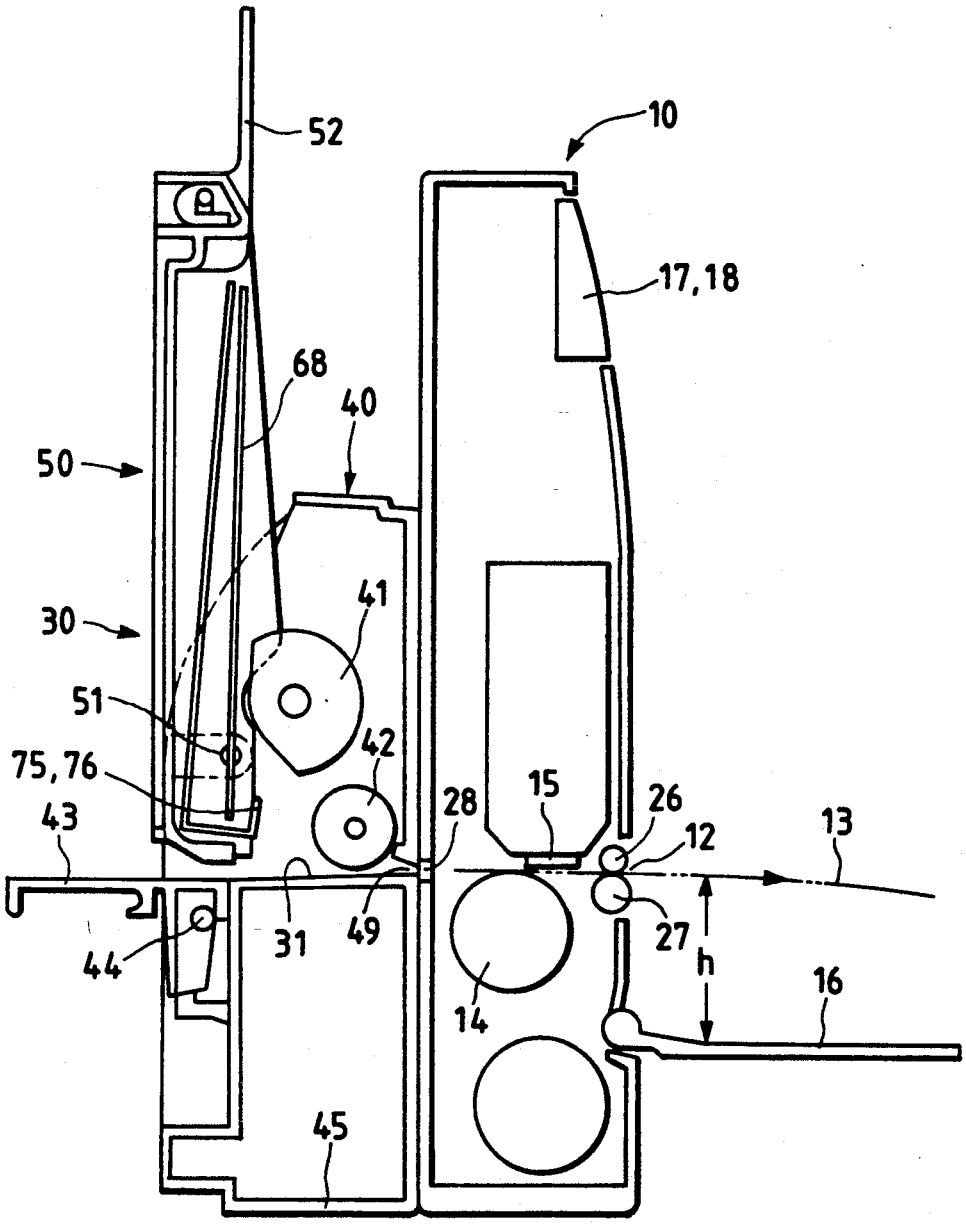
FIG. 2 is a view similar to FIG. 1, but showing a manual sheet supplying condition.

FIGS. 1 to 3 are elevational sectional views of the recording system 10 on which the sheet feeding apparatus 30 is mounted, in the cocked condition. Particularly, FIG. 1 shows a condition that an automatic sheet supply is effected, FIG. 2 shows a condition that a manual sheet supply is effected, and FIG. 3 shows a preserved condition, respectively.

In FIGS. 1 to 3, when the recording system 10 is in the cocked condition, a substantially straight sheet feeding path passing through the recording station (between the recording head 15 and the feed roller 14), i.e., a sheet feeding path extending from the second sheet introduction opening 28 to the sheet ejection opening 12 is formed. Now, the sheet feeding apparatus 30 is removably mounted on the rear or bottom surface (to which the second sheet introduction opening (inlet) 28 is opened) of the recording system 10 in such a manner that it is positioned to permit the sheet to be inserted from the inlet 28 into the straight sheet feeding path.

Further, the sheet feeding apparatus 30 is provided with a sheet path surface 31 for guiding the recording sheet, which path surface can be contiguous to the straight sheet feeding path.

Furthermore, ahead (left in FIGS. 1-3) of the sheet path surface 31, a manual sheet supply platform 43 which is used during the manual sheet supplying operation is pivotally mounted on a shaft 44 to be opened. The manual sheet supply platform 43 is folded downwardly for preservation during the automatic sheet supplying operation (FIG. 1) and during the preserved condition (FIG. 3); whereas, during the manual sheet supplying operation (FIG. 2), the platform 43 is extended or protruded in a horizontal direction to form a recording sheet guiding surface contiguous to the sheet path surface 31.

The sheet feeding apparatus 30 comprises a sheet supply drive portion 40 which can be fixedly connected to the recording system 10, and a sheet supply cassette portion 50 pivotally mounted for pivotal movement between a position (closed position) substantially perpendicular to the sheet supply drive portion 40 and a position (open position) inclined with respect to the sheet supply drive portion.

Figure 7:
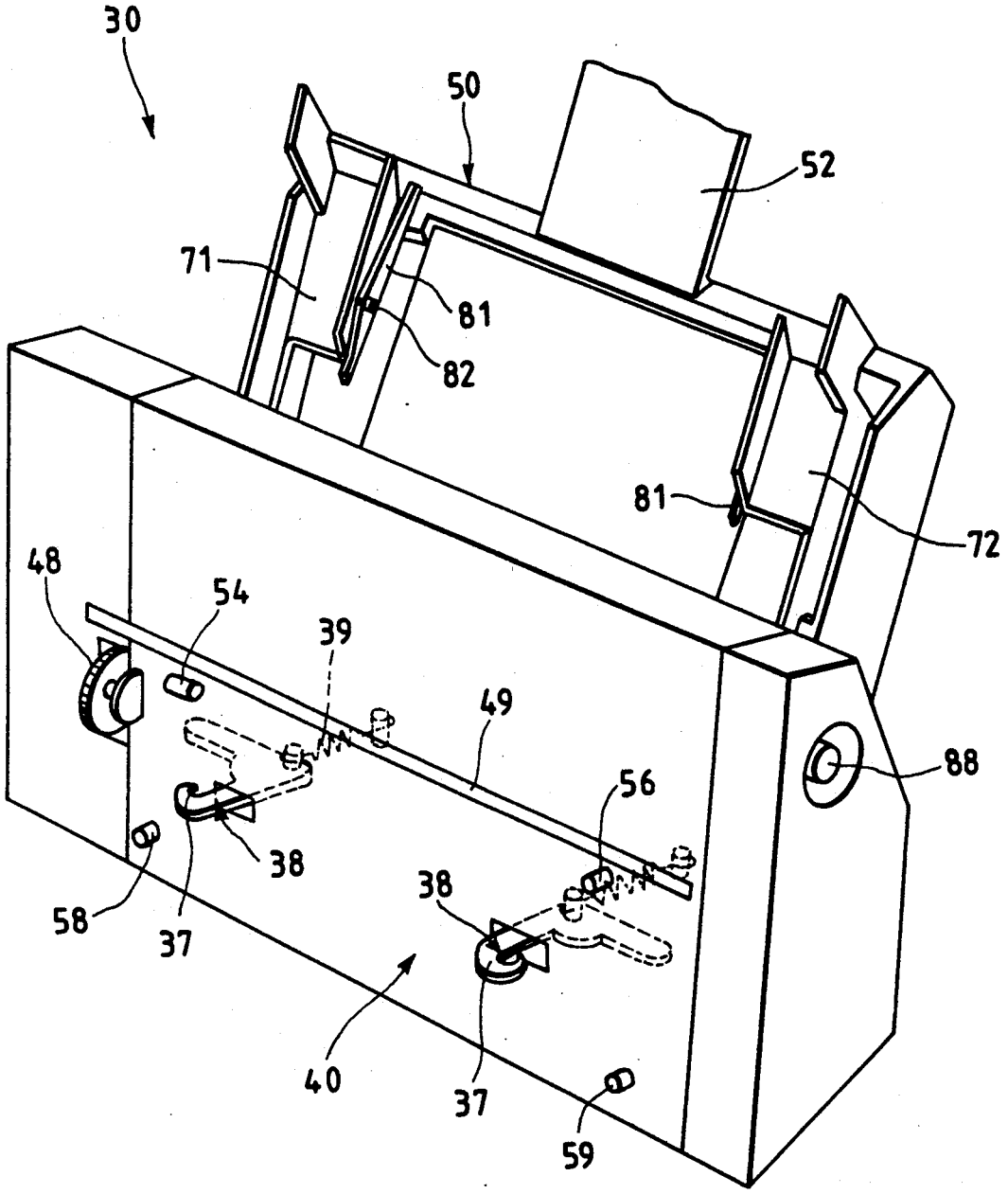
FIG. 7 is a side perspective view of the sheet feeding apparatus of FIG. 1.

FIG. 7 is a perspective view of the sheet feeding apparatus 30 of FIG. 1 in the automatic sheet supplying condition, looked at from a side to be connected to the recording system 10.

The recording sheets 13 are stacked in the sheet supply cassette portion 50 and the sheet supply drive portion 40 separates the recording sheets 13 one by one and supplies the sheet to the recording system 10.

In FIGS. 1-3 and 7, the sheet supply cassette portion 50 is pivotally mounted for open/close movement around a pivot 51, in confronting relation to an upper half of the sheet supply drive portion 40.

A sheet supply roller 41 and a sliding contact roller 42 are mounted on the portion (upper half) of the sheet supply drive portion 40 facing the sheet supply cassette portion 50. The sheet supply roller 41 comprises a plurality of rollers coaxially arranged on a common axis to apply a sheet feeding force to the recording sheet 13 and cooperating with separating pawls 75, 76 (described later) to separate the recording sheets 13 and to feed the sheet to the recording system 10. The sheet supply roller 41 is driven by utilizing the driving force for driving the feed roller 14 of the recording system 10.

The sliding contact roller 42 comprises a plurality of rollers coaxially arranged on a common axis parallel with the common axis for the sheet supply roller 41 and serving to guide the recording sheet 13 fed out by the sheet supply roller 41 to the recording system 10. The sliding contact roller 42 is driven by utilizing the driving force for driving the feed roller 14 of the recording system 10.

A foldable sheet supply tray 52 is mounted on the sheet supply cassette portion 50. In use, the tray is extracted to form a tray as shown in FIG. 1; whereas, in the preserved condition, the tray is folded within the cassette portion 50 as shown in FIG. 3.

A bottom portion 45 of a body frame of the sheet supply drive portion 40 constitutes a bottom surface when the sheet feeding apparatus 30 is mounted on the recording system 10 in the cocked condition, and cooperates with a rear surface (bottom surface in FIG. 1) of the recording system 10 to form a supporting surface for installing the whole system stably.

In the recording system 10 which is in the cocked condition and on which the sheet feeding apparatus 30 is mounted, as shown in FIG. 3, the cover (ejection tray) 16 is folded and the sheet supply cassette portion 50 is maintained in a vertical condition and the sheet supply tray 52 is closed, thus providing the preserved condition. In this preserved condition, the whole system has a substantially parallelepipedal shape with a flat bottom, thereby providing a compact cocked posture without any protrusions.

After the recording sheets 13 have been stacked in the sheet supply cassette portion 50 to permit the recording operation, when the automatic sheet supply is desired, as shown in FIG. 1, the sheet supply cassette portion 50 is opened (or inclined) and then the recording operation is started.

On the other hand, when the manual sheet supply is desired, as shown in FIG. 2, the sheet supply cassette portion 50 is maintained in the vertical condition (closed position) and the manual sheet supply platform 43 is cocked to form the sheet guiding surface so that the recording sheet 13 can be supplied to the recording system through the sheet path surface 31.

Incidentally, in the illustrated embodiment, a clearance for passing the recording sheet during the automatic sheet supplying operation and during the manual sheet supplying operation is formed between the sliding contact roller 42 and the sheet path surface 31. An outlet 49 for the recording sheet 13 is formed in the abutment surface (mounting surface) of the sheet feeding apparatus 30.

On the other hand, the sheet ejection tray provided by opening the cover 16 is arranged at the side of the outlet (sheet ejection opening) 12 of the sheet feeding path in the recording system 10. As shown, the sheet ejection tray 16 is attached to the recording system to extend in a substantially horizontal direction at a height lower than the sheet ejection opening 12 by a predetermined distance h.

Next, a connecting mechanism between the recording system 10 and the sheet feeding apparatus 30 will be explained.

Figure 8:
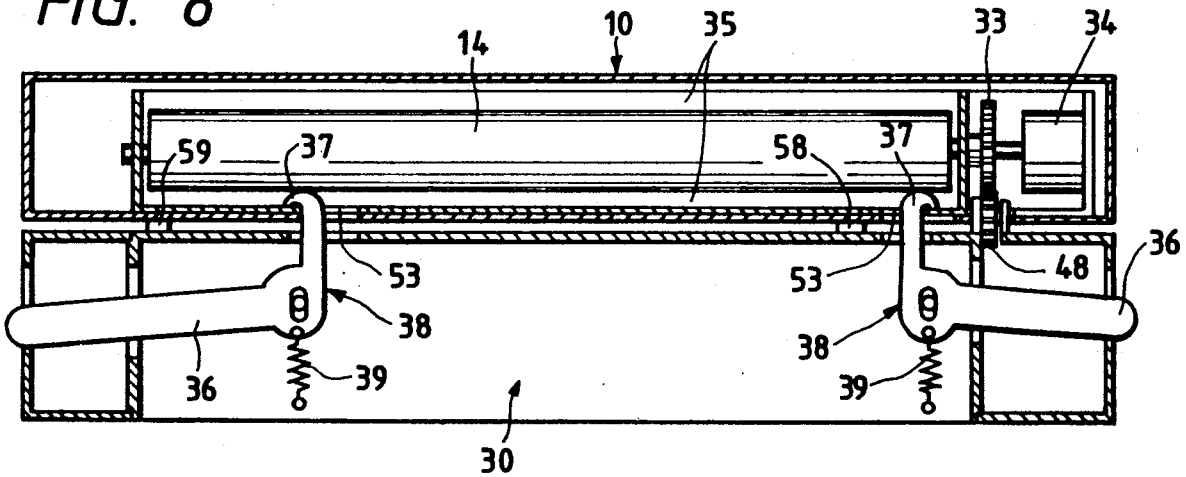
FIG. 8 is a sectional view showing a condition that a hook connection between the recording system and the sheet feeding apparatus of FIG. 1 is locked.
Figure 9:
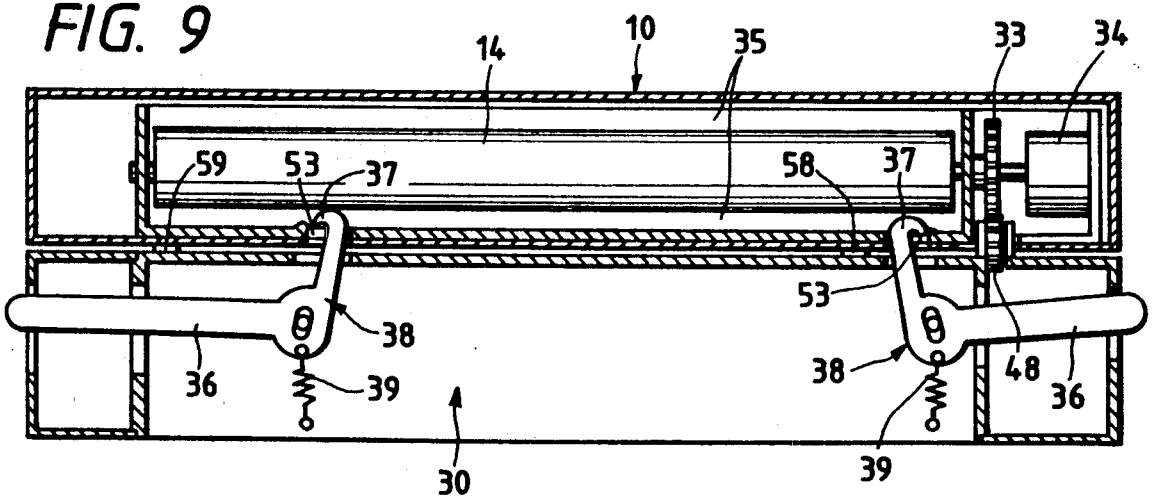
FIG. 9 is a view similar to FIG. 8, but showing a lock released condition.

FIG. 8 is a horizontal sectional view showing a connecting condition between the recording system 10 and the sheet feeding apparatus 30, and FIG. 9 is a sectional view showing a condition that the lock is released from the condition of FIG. 8.

A drive gear 33 rotated in synchronous with the feed roller (platen roller) 14 is rotatably supported by a frame member 35 within the recording system 10, and a driven gear (transfer gear) 48 meshed with the drive gear 33 is rotatably supported on the mounting surface of the sheet feeding apparatus 30, as shown in FIGS. 7 to 9, so that the driving force of the feed roller 14 of the recording system 10 is transmitted to the sheet feeding apparatus. The feed roller 14 and a feed motor 34 are rotatably supported in bearing portions formed in the frame member 35, and the frame member 35 is connected to the body frame of the recording system 10.

On both left and right sides of the sheet feeding apparatus 30, a pair of hook members 38 each having a lever 36 and an end hook 37 are arranged in a substantially symmetrical relation so that they can be rocked and shifted in a front and rear direction by a predetermined distance. Each hook member 38 is biased inwardly by means of a corresponding tension spring 39. The hook 37 of each hook member 38 is protruded from the mounting surface of the sheet feeding apparatus 30 by a predetermined amount.

On the other hand, at positions on the frame member 35 of the recording system which correspond to the hooks 37, openings 53 for passing the hooks 37 are formed, so that each hook 37 can be locked against a peripheral edge portion of the corresponding opening 53.

As shown in FIGS. 8 and 9, beads for easily and surely locking the respective hooks 37 thereon are formed on the peripheral edge portion of the openings 53.

In the condition that the hooks 37 are locked as shown in FIG. 8, the tension springs 39 are extended (for example, by 1–2 mm), with the result that the sheet feeding apparatus 30 is pulled toward the recording system 10, thus abutting them against each other.

Each hook member 38 is shifted from the locked position shown in FIG. 8 to the released position shown in FIG. 9 by rotating it via the lever 36, with the result that the sheet feeding apparatus 30 can be detached from the recording system 10.

Figure 10:
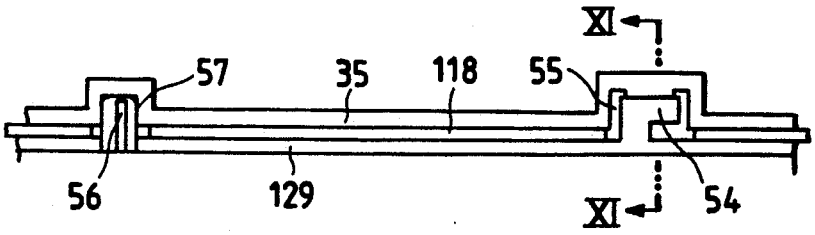
FIG. 10 is a sectional view showing positioning and engaging portions between the recording system and the sheet feeding apparatus of FIG. 1.

Engagement portions by which the sheet feeding apparatus 30 is abutted against the recording system 10 for positioning the former are arranged at left and right positions above the hook members 38 by predetermined distances. FIG. 10 is a horizontal sectional view of such engagement portions, and FIG. 11 is a partial sectional view taken along the line XI—XI in FIG. 10.

Figure 11:
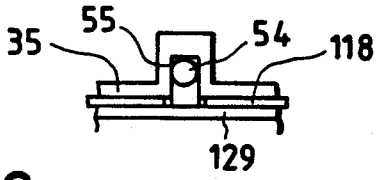
FIG. 11 is a sectional view taken along the line VI—VI in FIG. 10.

In FIGS. 7, 10 and 11, the engagement portion near (right in FIG. 10) the driven gear 48 is constituted by an abutment projection 54 formed on the sheet feeding apparatus 30, and a recess 55 formed in the frame member 35 of the recording system 10. By fitting the projection 54 into the recess 55, the spacing between the sheet feeding apparatus 30 and the recording system 10 is determined and the positioning of the sheet feeding apparatus with respect to the recording system in the up-and-down direction is effected. That is to say, in the engagement portion comprising the projection 54 and the recess 55, a slight clearance is provided only in the left and right direction.

On the other hand, the engagement portion opposite (left in FIG. 10) to the driven gear 48 is constituted by a projection 56 formed on the sheet feeding apparatus 30, and a recess 57 formed in the body frame 35 of the recording system 10. By fitting the projection 56 into the recess 57, the spacing between the sheet feeding apparatus 30 and the recording system 10 is determined and the positioning of the sheet feeding apparatus with respect to the recording system in up-and-down and front-and-rear directions is effected.

Incidentally, in the example as shown, while the engagement portions for abutment and positioning of the sheet feeding apparatus were arranged above the left and right hook members 38 (FIGS. 8 and 9), these engagement portions may be arranged below the hook members, if necessary.

With the arrangement as mentioned above, in the recording system 10 in the cocked condition, which has the straight sheet feeding path passing through the recording station and on which the sheet feeding apparatus 30 driven by the driving force of the feed roller 14 is mounted, the pair of left and right spring-biased movable hooks 38 disposed on the mounting surface of the sheet feeding apparatus 30 can be engaged by the left and right receiving portions formed in the frame member 35 of the recording system, and the left and right abutment and positioning engagement elements 54, 55, 56, 57 are arranged above the movable hooks 37.

According to the recording system having such arrangement, when the sheet feeding apparatus 30 is mounted on the recording system 10, an axial distance between the driving force transmitting gears 33, 48 can be correctly determined, so that it is possible to correctly drive the sheet supply roller 41 without changing the axial distance due to the vibration and/or external forces in use, thus providing the recording system capable of supplying the sheet stably.

Further, in the example as shown, as shown in FIG. 7, auxiliary abutment projections 58, 59 are formed on the mounting surface of the sheet feeding apparatus 30. These projections 58, 59 are disposed so that they face the mounting surface of the recording system 10 with a slight clearance (for example, about 0.3 mm) to prevent the play of the sheet feeding apparatus 30 when it is mounted.

Figure 12:
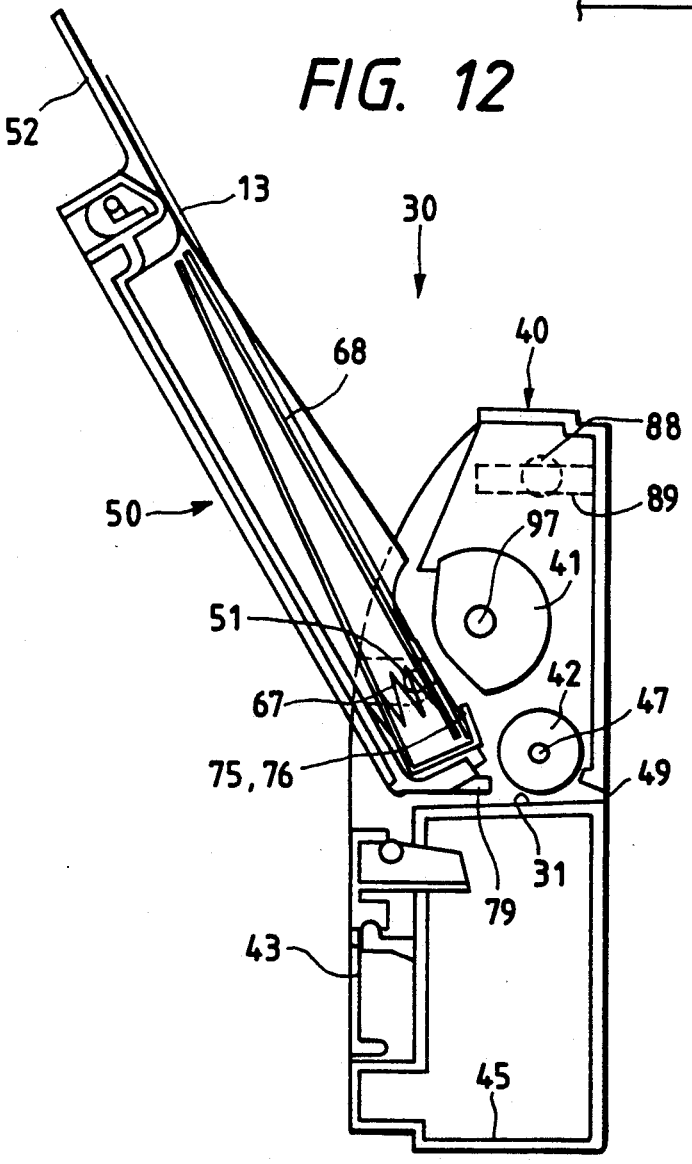
FIG. 12 is a schematic sectional view of the sheet feeding apparatus of FIG. 1 in the automatic sheet supplying condition.
Figure 13:
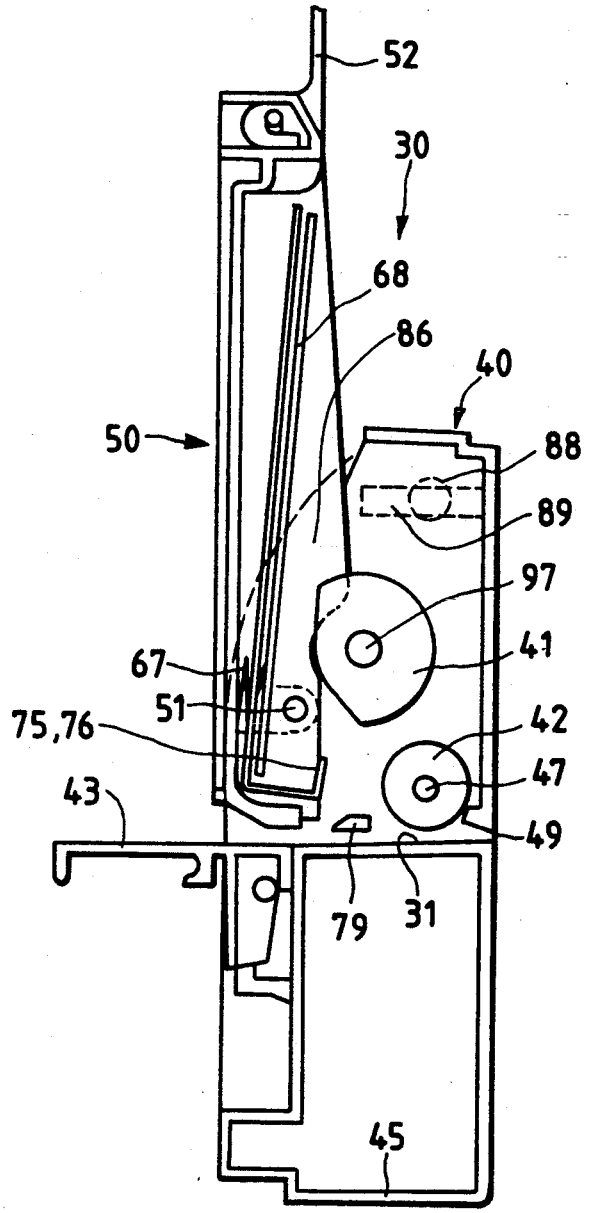
FIG. 13 is a schematic sectional view of the sheet feeding apparatus of FIG. 1 in the manual sheet supplying condition.

FIG. 12 is an elevational sectional view of the sheet feeding apparatus 30 in the automatic sheet supplying condition, and FIG. 13 is an elevational sectional view of the sheet feeding apparatus 30 in the manual sheet supplying condition (or a condition that the recording sheets can be loaded).

In FIGS. 12 and 13, a pressure plate 68 biased toward the sheet supply roller 41 by means of a pressure spring 67 is mounted on the sheet supply cassette portion 50. Further, a pair of sliders 71, 72 (see FIG. 14) are supported on the sheet supply cassette portion 50 in such a manner that a distance between the sliders can be adjusted in correspondence to the width of the recording sheet 13.

Figure 14:
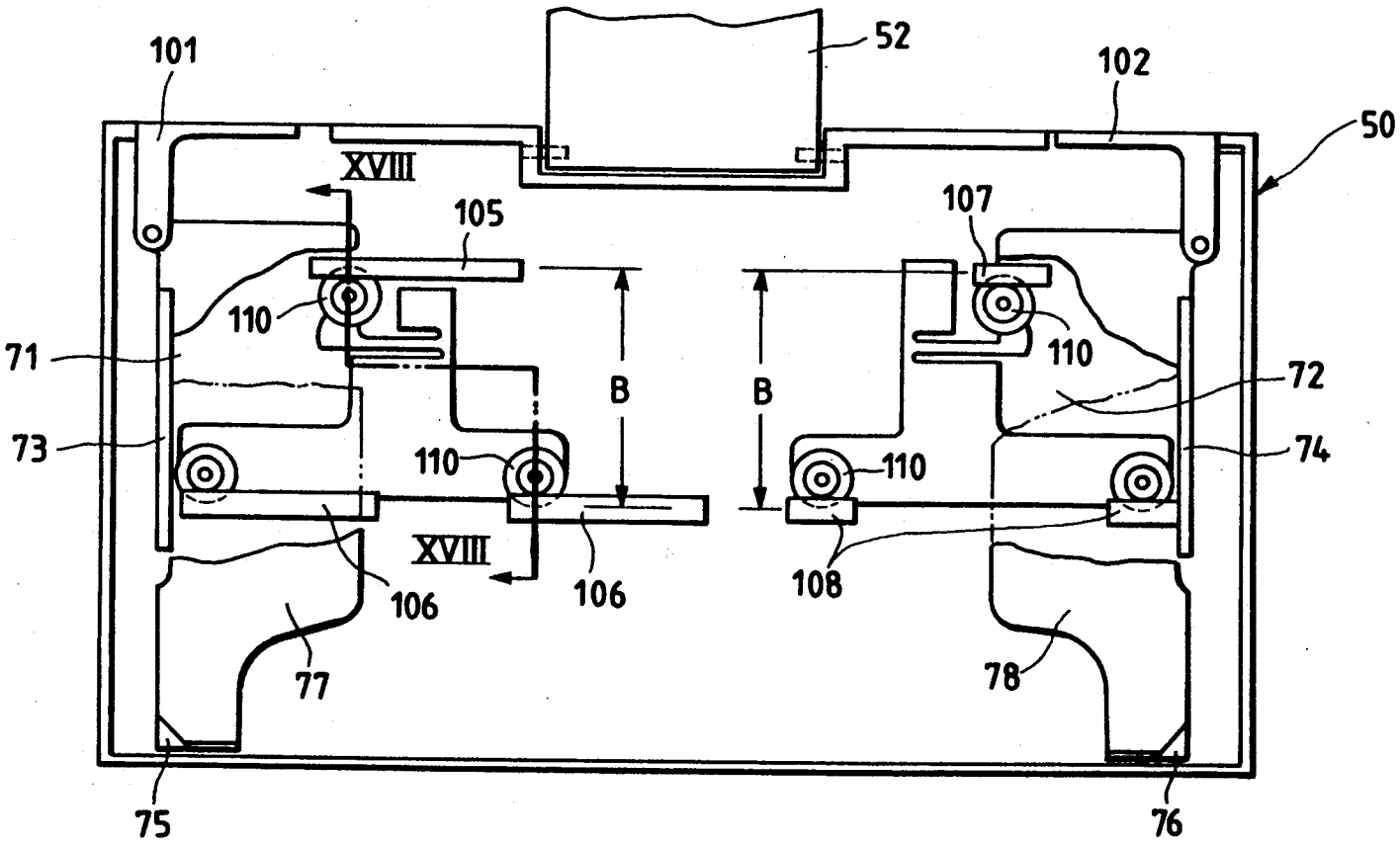
FIG. 14 is a side elevational view, partial in section, of a sheet supply cassette portion of the sheet feeding apparatus of FIG. 12.
Figure 15:
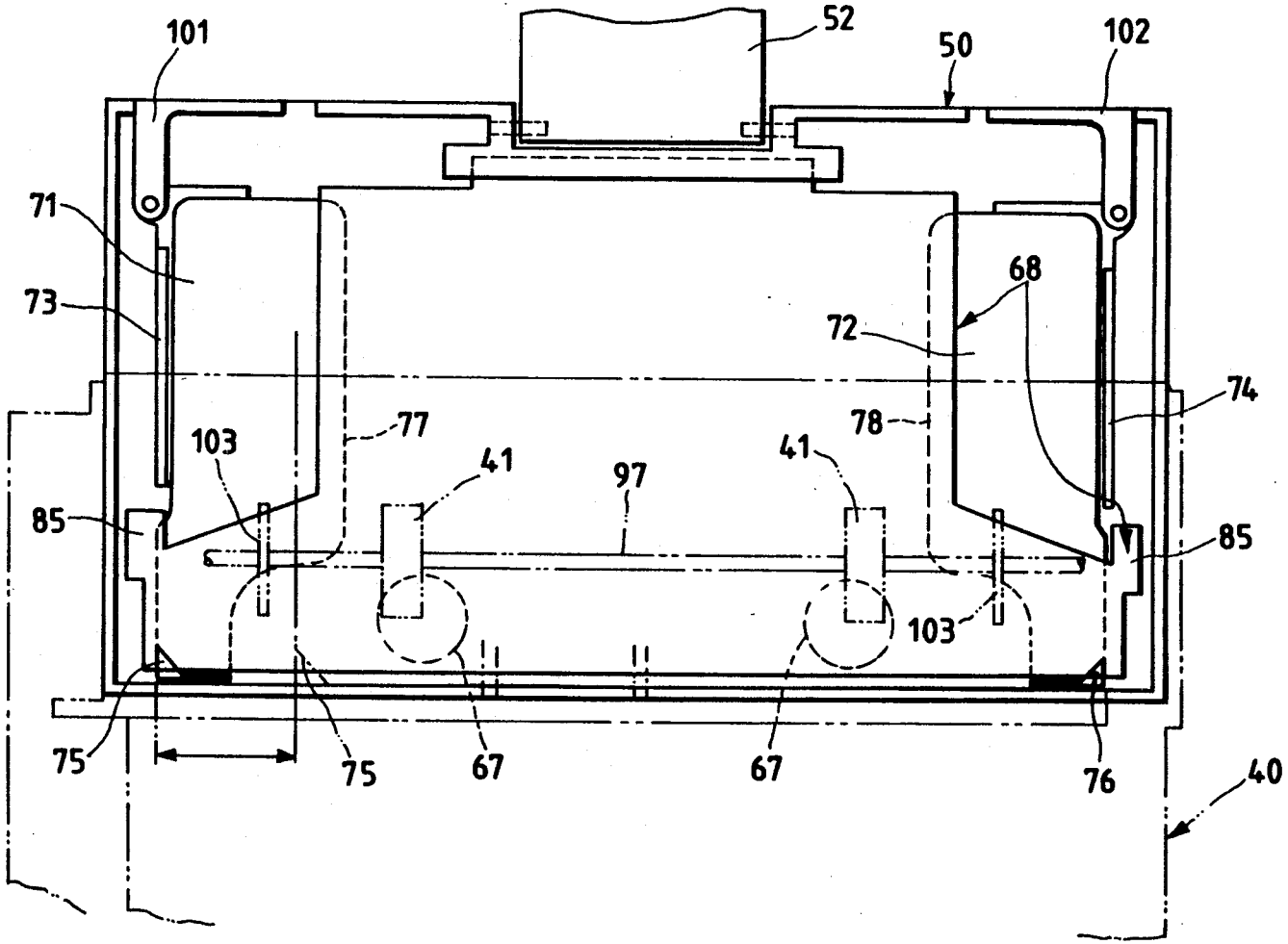
FIG. 15 is a side elevational view of the sheet supply cassette portion of the sheet feeding apparatus of FIG. 12.

FIG. 14 is an elevational view, partially in section, of the sheet supply cassette portion 50 for showing the sliders 71, 72 by removing the pressure plate 68, and FIG. 15 is an elevational view, partially in section, of the sheet supply cassette portion 50 for showing the sliders 71, 72 and the pressure plate 68.

In FIGS. 12–15, side guides 73, 74 for abutting against both lateral edges of the loaded sheets 13 and separating pawls 75, 76 capable of engaging with both front corners of the loaded sheets 13 are provided on the left and right sliders 71, 72. Incidentally, the separating pawls 75, 76 are formed on front ends of separating pawl members 77, 78 secured to the sliders 71, 72. The separating pawl members 77, 78 are generally made of metal plates such as copper plates.

In the illustrated example, the sliders 71, 72 are mounted on the case of the sheet supply cassette portion 50 so that one of the sliders can be greatly shifted in the left and right direction in accordance with the width of the recording sheet and the other can be shifted in the left and right direction in a smaller extent. However, only one of the sliders may be shifted in accordance with the width of the sheet, if necessary.

As shown in FIG. 12, the loaded recording sheets 13 are held between the pressure plate 68 and the separating pawls 75, 76. In the automatic sheet supplying operation, the sheet feeding force is applied to the sheet 13 by contacting the rotating D-shaped (or semi-circular) sheet supply roller 41 with the recording sheet.

While the sheet supply roller 41 is being rotated, an uppermost recording sheet is separated from the other sheets and then is fed to a heating position in the recording system 10 via the sliding contact roller 42. The sliding contact roller 42 is arranged in the vicinity of the sheet path surface 31 in parallel with the sheet supply roller 41 and is rotatingly driven in synchronous with the feed roller 14 of the recording system 10 at a peripheral speed slightly faster (for example, 8%) than that of the feed roller.

On the other hand, although the sheet supply roller 41 is also driven by the driving force of the feed roller 14, this sheet supply roller is ON/OFF controlled during its normal rotation. Since the sheet supply roller is driven via a spring clutch 98 of one-way clutch type (FIG. 17) which is turned OFF in the reverse rotation of the roller, the sheet supply roller is driven only in the normal direction at a predetermined timing during the heading of the recording sheet 13 and the like.

Figure 16:
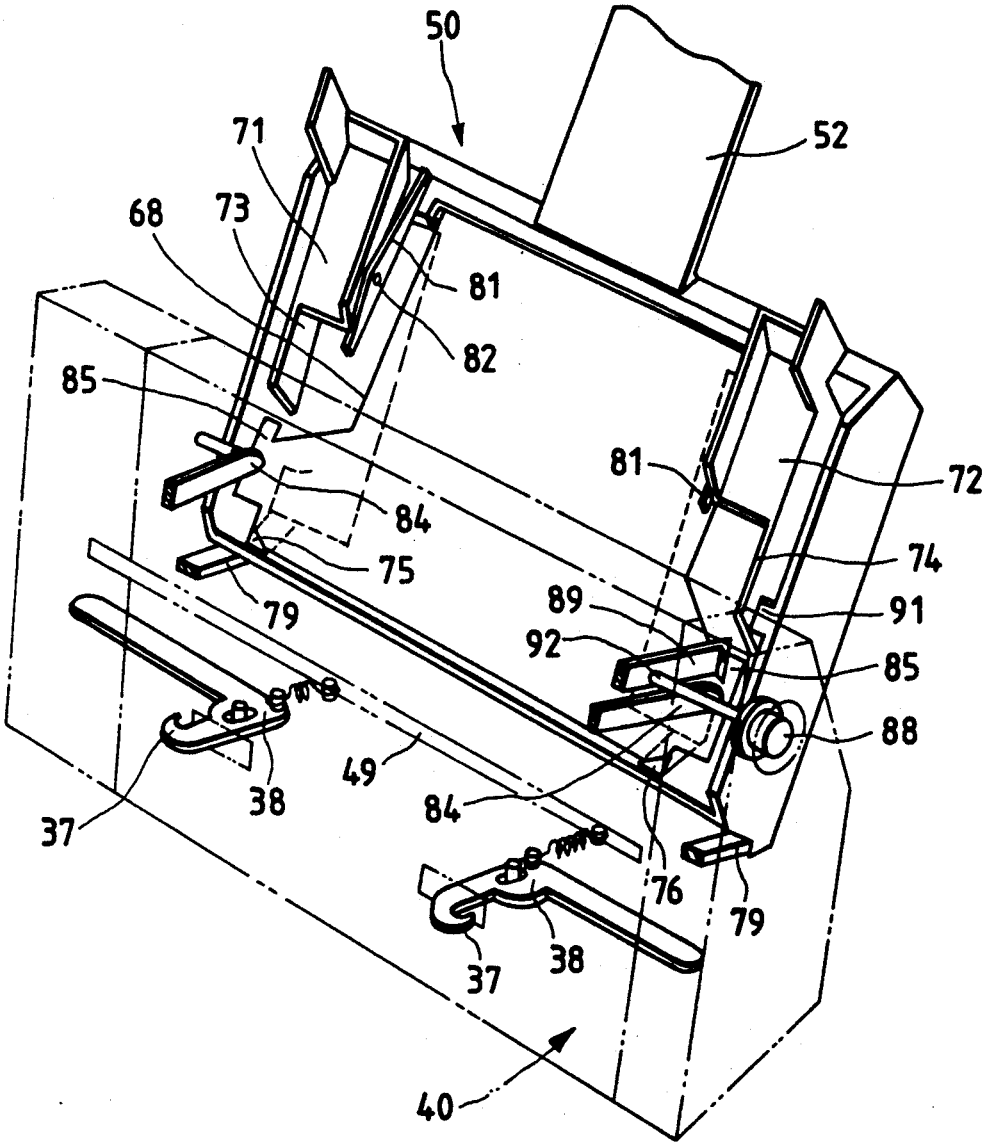
FIG. 16 is a partially sectional perspective view showing an actuator mechanism between a sheet supply drive portion and the sheet supply cassette portion of the sheet feeding apparatus of FIG. 12.

FIG. 16 schematically shows various engagement members operated when the sheet supply cassette portion 50 is pivoted with respect to the sheet supply drive portion 40 between a vertical closed position and an inclined open position (automatic sheet supplying position).

In FIGS. 12 and 16, stoppers 79 for abutting against lower portions of the sheet supply cassette portion 50 to hold the cassette portion in the inclined position (automatic sheet supplying position) are formed on both sides of the case of the sheet supply drive portion 40.

Further, sheet introduction prohibiting means (sheet introduction prohibiting levers) 81 for preventing the insertion (loading) of the recording sheet 13 at the automatic sheet supplying position are provided on the sliders 71, 72, respectively. The levers 81 are pivotally mounted on the respective sliders 71, 72 via respective pins 82 so that, in the automatic sheet supplying position as shown in FIG. 12, the levers are rotated by their own weights to contact upper ends of the levers with the upper surface of the recording sheet 13 near an insertion opening 83.

Thus, even if an operator tries to insert a new recording sheet, since a leading end of the new sheet is blocked by the levers 81, the new sheet cannot be inserted into the cassette.

On the other hand, when the sheet supply cassette portion 50 is rotated in the vertical position, as shown in FIG. 13, lower ends of the sheet introduction prohibiting levers 81 are abutted against the end surface of the case of the sheet supply drive portion 40 and the levers 81 are rotated around the pins 82 in anti-clockwise directions by predetermined amounts, with the result that upper ends of the levers are lifted to open the insertion opening 83, thus permitting the insertion of the recording sheet 113 into the cassette.

Further, in FIGS. 13 and 16, pressure plate urging members 84 projecting toward the cassette portion 50 are disposed on both sides of the case of the sheet supply drive portion 40. When the sheet supply cassette portion 50 is in the vertical (closed) position, the urging members 84 are abutted against ears 85 (FIG. 15) formed on both sides of the pressure plate 68, thus lowering the latter. Consequently, as shown in FIG. 13, the distance between the sheet supply roller 41 and the pressure plate 68 is increased to form an insertion space 86 for the recording sheet 13, thus permitting the loading of the new recording sheet 13.

In this condition, the fixed separating pawls 75, 76 provided on the respective sliders 71, 72 remain in fixed positions corresponding to the sheet supply roller 41 or slightly overlapping with the sheet supply roller, as shown in FIG. 13. Further, since a guide projection 87 slightly protruding above the sheet supply roller 41 is disposed at an introduction side of the sheet supply roller 41, the inserted recording sheet 13 can be surely loaded between the separating pawls 75, 76 and the pressure plate 68.

The sheet supply cassette portion 50 is held in the vertical position (closed position) by means of a ratch mechanism which is released when a push button 88 (FIGS. 13 and 16) is depressed. When the push button 88 is depressed to release the ratch mechanism, the sheet supply cassette portion is automatically returned to the inclined position (open position) by a reaction force of the biasing spring 67 for the pressure plate 68.

As shown in FIG. 16, the ratch mechanism comprises a hooked lever 89 provided on the case of the sheet supply drive portion 40, and an engagement portion 91 formed on the case of the sheet supply cassette portion 50. By engaging the hooked lever by the engagement portion, the sheet supply cassette portion 50 is held in the vertical position. In this condition, when the push button 88 is depressed, a free end 92 (FIG. 16) of the push button elastically deforms the hooked lever 89 to disengage the latter from the engagement portion 91, thus releasing the ratch mechanism.

Figure 17:
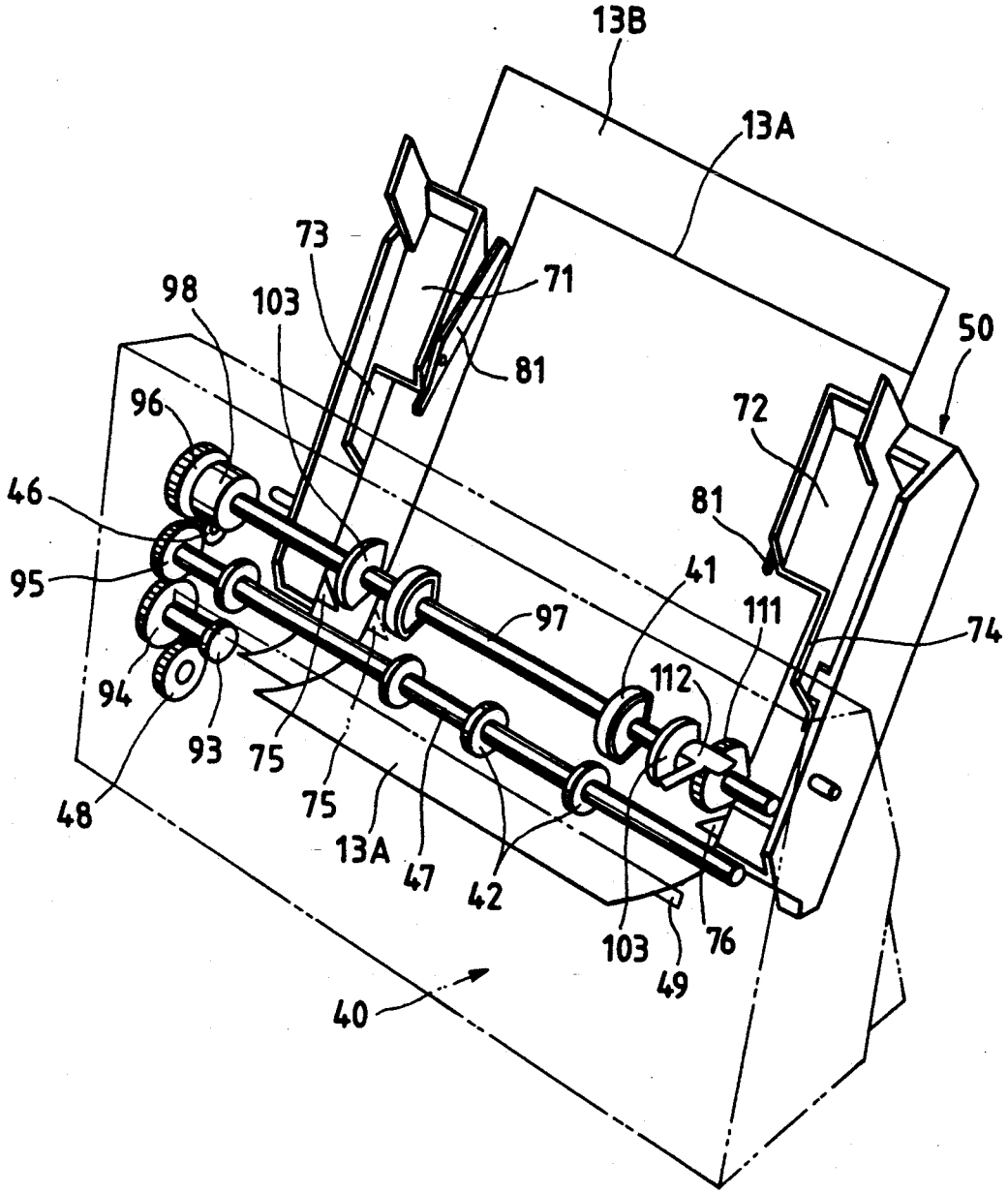
FIG. 17 is a partially sectional perspective view showing a drive mechanism for a sheet supply roller of the sheet feeding apparatus of FIG. 12.

FIG. 17 is a perspective view showing a drive system for the sheet supply roller 41 and the sliding contact roller 42, and the positional relation therebetween.

In FIG. 17, the rotation of the driven gear (transfer gear) 48 driven in synchronous with the rotation of the feed roller 14 of the recording system 10 is transmitted to a roller shaft 97 of the sheet supply roller 41 via a gear train 93, 94, 95, 46, 96. Incidentally, the intermediate gear 95 is fixedly mounted on a roller shaft 47 of the sliding contact roller 42. Further, the gears 93, 94, 46 are idler gears.

The gear 96 is mounted in coaxial relation to the roller shaft 97 of the sheet supply roller 41, and the gear 96 is connected to the roller shaft 97 via a one-way clutch (for example, spring clutch) 98. The one-way clutch 98 is constituted by a spring clutch which always remains an OFF condition in the reverse direction and is ON/OFF controlled in the normal direction. For example, the one-way clutch 98 is activated as follows:

First of all, when the feed roller 14 is reversely rotated by a small amount in the reverse direction (opposite to the sheet feeding direction), the one-way clutch 98 is changed to the ON condition by the reverse rotation of the gear 96 (clutch trigger). In this ON condition, the sheet supply roller 41 can be rotated normally by the normal rotation of the feed roller 14. In this case, the sheet supply roller 41 having D-shaped (or semi-circular) cross-section (i.e., not cylindrical) is maintained in a reference or initial position where the roller is spaced away from the recording sheet 13.

Then, when the feed roller 14 is rotated by the predetermined amount in the normal direction, the sheet supply roller 41 is also rotated in synchronous with the feed roller, thus feeding one recording sheet 13 up to a position exceeding the nip of the feed roller 14. The face that the recording sheet 13 reaches the nip is detected by a sensor, and a stop position of the feed roller 14 at this time is controlled by a detection signal from the sensor.

Then, the feed roller 14 is rotated by the predetermined amount in the reverse direction, thereby retarding a leading end of the recording sheet to a position out of the nip. By this reverse rotation of the feed roller 14, a loop is formed in the leading end portion of the recording sheet 13, thus performing the registration of the sheet 13 (positioning the leading end of the sheet in parallel with the feed roller).

The one-way clutch (for example, spring clutch) 98 still remains in the ON condition due to the clutch trigger, thus permitting the transmission of the rotation in the normal direction.

Now, the feed roller 14 is rotated by the predetermined amount in the normal direction. Consequently, by the normal rotations of the feed roller 14 and the sheet supply roller 41, the recording sheet 13 is fed to the recording start position (heading position). During such normal rotation, when the D-shaped sheet supply roller 41 is separated from the recording sheet 13, that is, when the sheet supply roller 41 is returned to its reference position (initial position) after one revolution thereof, the one-way clutch 98 is turned OFF, thus stopping the sheet supply roller 41 at the reference position.

In this way, during one revolution of the sheet supply roller 41, only one recording sheet 13 is supplied to the recording system 10 and is set to the heading condition.

Thereafter, on the basis of image information, the recording operation is effected regarding the recording sheet 13. During the recording operation, the one-way clutch 98 remains in the OFF condition, and, thus, the sheet supply roller 41 remains in the stopped condition, regardless of the normal rotation of the feed roller 14 (feeding of the sheet).

Figure 19:
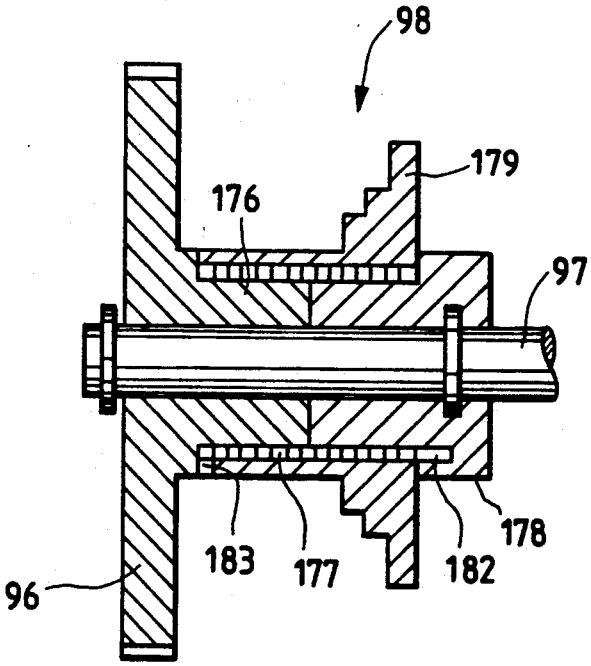
FIG. 19 is an elevational sectional of a one-way clutch of FIG. 17.
Figure 21:
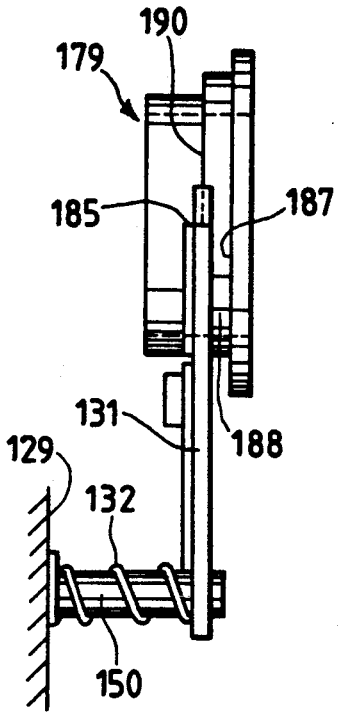
FIG. 21 is a side view looked at from the right of FIG. 20.
Figure 22:
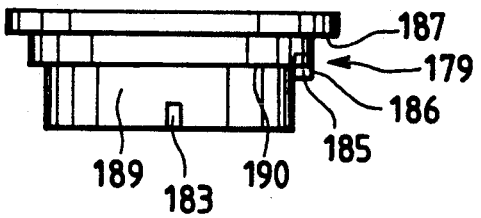
FIG. 22 is a side view of the control ring looked at from the top of FIG. 20.
Figure 23:
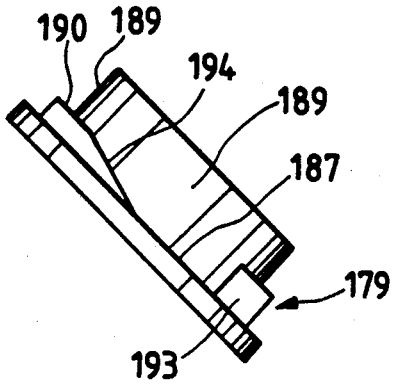
FIG. 23 is a side view of the control ring looked at from the bottom of FIG. 20.

FIG. 19 is an elevational sectional view showing the construction of the one-way clutch (spring clutch) 98, and FIGS. 21–23 show a control ring of FIG. 19 and a control lever 131 for regulating the operation of the control ring.

The one-way clutch (spring clutch) 98 attached to the roller shaft 97 of the sheet supply roller is provided with a boss (barrel) portion 176 integrally formed with the gear (gear clutch) 96, a coil-shaped clutch spring 177, a clutch drum 178, and a control ring 179.

Further, as shown in FIG. 20–23, the control lever 131 for controlling the clutch operation is biased radially inwardly and axially by a control spring 132 to abut against the control ring 179. The clutch drum 178 is secured to the roller shaft 97 of the sheet supply roller to rotate therewith.

On the other hand, the clutch gear 96 having the boss portion 176 is freely rotatably mounted on the roller shaft 97. Clutch spring receiving recesses are formed in peripheral surfaces of the boss portion 176 and the clutch drum 178, and the coil-shaped clutch spring 177 is received in these recesses to extend therebetween.

One end of the clutch-spring 177 is engaged by a hole 182 formed in the clutch drum 178 to be always connected to the clutch drum 178. The other end of the clutch spring 177 is hooked in the notch 183 formed in the control ring 179 rotatably mounted around the clutch spring 177. The control ring 179 has a shape as shown in FIGS. 20–23, and the anticlockwise rotation (FIG. 20) of the control ring corresponds to the sheet feeding direction of the sheet supply roller 41.

Figure 20:
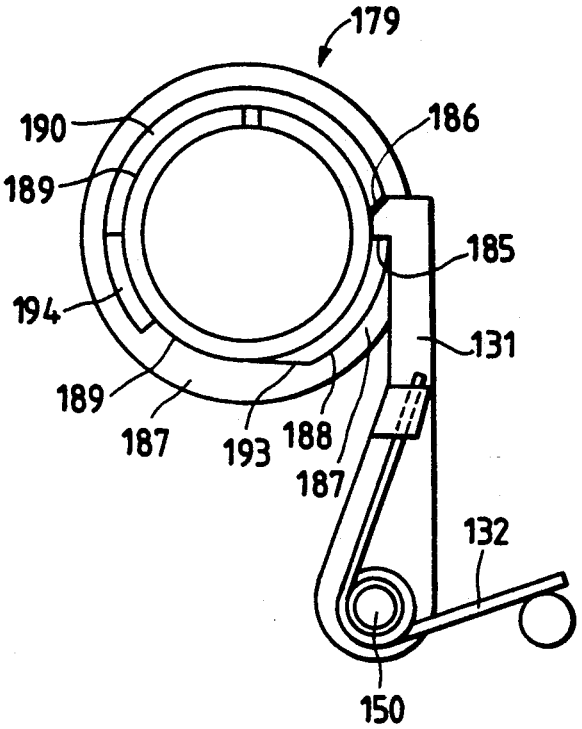
FIG. 20 is an elevational view showing a control ring and a control lever of FIG. 19.

The control lever 131 is rotatably fitted on a shaft portion 150 formed on a case body 129, and is biased axially (right in FIG. 21) and radially inwardly toward the control ring 179 by means of the control spring 132, as shown in FIGS. 20 and 21. In a sheet supply waiting condition (the reference position where the sheet supply roller 41 does not contact the recording sheet), the control lever 131 is locked or fitted in a notch 185 formed in the control ring 179.

When a sheet supply command is emitted from a control portion, first of all, the feed roller 14 is rotated by the predetermined amount in the reverse direction, and, in synchronous with this reverse rotation, the control ring 179 is rotated in the reverse direction (clockwise direction) by predetermined steps via the clutch gear 96 and clutch spring 177.

That is to say, when the feed roller 14 is rotated reversely, the clutch gear 96 is rotated in the direction that the clutch spring 177 wound around the boss portion (barrel portion) 176 is released. However, in effect, since the load due to the contact between the roller shaft 97 and the recording sheet 13 is small, the torque is generated by the spring clutch 177 wound around the boss portion so that the rotation of the clutch gear 96 is transmitted to the spring, with the result that the control ring 179 connected to the end of the clutch spring 177 is rotated in the reverse direction by the predetermined steps. The reverse rotation of the control ring 179 causes the control lever 131 to shift radially inwardly of the control lever along an inclined portion 186 of the notch 185 of the control ring 179, whereby the control lever slides on surfaces 187, 188.

Then, the control ring 179 is rotated in the normal direction by about one revolution. That is to say, when the clutch gear 96 is rotated normally in synchronous with the normal rotation of the feed roller 14, the clutch spring 177 wound around the boss portion 176 is rotated to be fastened, with the result that the boss portion 176, clutch spring 177 and clutch drum 178 are integrally rotated, thus transmitting the torque to the roller shaft 97 and the sheet supply roller 41 to rotate the latter in the normal direction. At the same time, the control ring 179 connected to one end of the clutch spring 177 is also rotated in the same direction.

By such rotations and the biasing force of the control spring 132, the control lever 131 is shifted onto the surface 188 and is urged against the surface 187, whereby the control lever slides along the surfaces 187, 188. Due to this normal rotation (rotation in the normal direction), the sheet supply roller 41 is driven to start the supplying of the recording sheet 13.

After a predetermined angle of the normal rotation is finished, the control lever 131 is firstly lowered onto a surface 189 through an inclined surface 193 and then is directed to be contacted with the surface 189 through a surface 194. When the normal rotation is further continued, the free end of the control lever 131 is caught by the notch 185 of the control ring 179, thus stopping the rotation of the control ring 179.

That is to say, the predetermined angle of the normal rotation causes the control lever 131 to drop onto the surface 189 through the inclined surface 193, whereby the control lever slides along the surfaces 187, 189 by a predetermined angle. The further normal rotation causes the control lever 131 to lift along the inclined surface 194 and then to slide on the surfaces 189, 190. When the normal rotation is further continued to complete one revolution, the control lever is separated from the surfaces 189, 190 and is dropped into the notch 185, thus stopping the rotation of the control ring 179.

When the control ring 179 is stopped, the one-way clutch 98 is again turned OFF (condition that the torque is not transmitted even in the normal rotation).

In summary, the initial reverse rotation (predetermined number of pulses) of the control ring 179 provides the sheet supply trigger for rotating the sheet supply roller 41 by one revolution. Then, while the control ring 179 is rotated in the normal direction by one revolution, the sheet supply roller 41 is driven. When the sheet supply roller 41 and the control ring 179 return their initial position after their one revolutions, the control lever 135 is engaged by the notch 185 again to turn the clutch OFF, thus stopping the sheet supply roller 41 at the reference position. In this way, by rotating the sheet supply roller 41 by utilizing the driving force of the feed roller 14, the supplying operation for the recording sheet 13 is completed.

As explained with reference to FIGS. 14 and 15 and the like, the sliders 71, 72 are provided with the side guides 73, 74 for regulating the width of the recording sheet 13 and the separating pawls 75, 76 for engaging with both front corners of the recording sheet 13. Since the separating pawls 75, 76 are provided on the sliders 71, 72 rather than on the pressure plate 68 lowered by the sheet supply roller 41, the pawls are, so-called, of fixed type.

In FIGS. 14 and 15, each slider 71, 72 is shifted by the manual operation. By setting clamp levers 101, 102 to positions as shown, guide grooves (not shown) are pressurized on both sides by means of face cam means (not shown), thus setting the sliders at the desired widthwise position by the friction force.

In FIG. 17, the sheet supply roller 41 comprises a plurality of rollers integrally mounted on the roller shaft 97 at plural positions (two positions in the illustrated embodiment). The roller shaft 97 is also provided with suspected or false rollers 103 integrally mounted on this roller shaft on both outer sides of the sheet supply rollers.

These false rollers 103 have substantially the same profice (D-shape and the like) as that of the sheet supply roller 41, but have different width and material from those of the sheet supply roller, so that, although the false rollers contact the recording sheet during the sheet supplying operation, they do not generate the feeding force. For example, the peripheral surface of the sheet supply roller 41 is constituted by material such as rubber providing the great friction force, whereas, the peripheral surfaces of the false rollers 103 are constituted by plastic material such as Teflon (trade mark) or nylon (for example, made of the material same as that of the roller shaft 97 and formed integrally with the latter) to provide smooth surfaces.

By additionally providing the false rollers 103 having the simple construction, even when the sheet supply roller 41 is fixedly positioned, the separating pawls 75, 76 can always perform their separating function properly, regardless of the widths of the recording sheets 13. Accordingly, it is not necessary to use the expensive slide-arrangement for the sheet supply roller 41, thus making the system inexpensive.

On the other hand, the sliding contact roller 42 comprises a plurality of rollers integrally mounted on the roller shaft 47 of the sliding contact roller at plural positions (for example, 3 to 5 positions) equidistantly.

Figure 18:
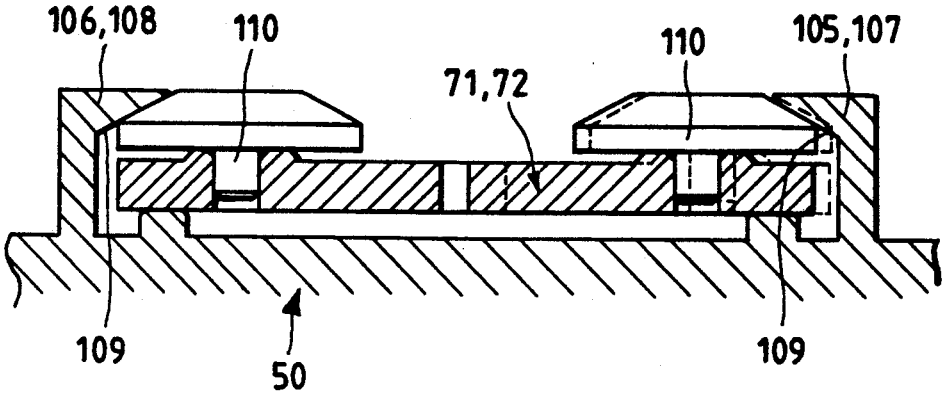
FIG. 18 is an elevational sectional view of guide rollers for a slider, taken along the line X VIII—X VIII in FIG. 14.

FIG. 18 is a partial sectional view taken along the line X VIII—X VIII in FIG. 14. Now, the guide construction for the sliders 71, 72 will be described with reference to FIGS. 14 and 18.

In FIGS. 14 and 18, guide rails 105, 106, 107, 108 are formed on an inner surface of the case of the sheet supply cassette portion 50 at a predetermined distance B. The left slider 71 is guided by the guide rails 105, 106 and the right slider 72 is guided by the guide rails 107, 108.

As shown in FIG. 18, each guide rail 105—108 is of dovetail groove type wherein a dovetail groove 109 (groove having a tapered surface) is formed in the inner surface of the rail. The guide rails 105—108 are integrally formed with the plastic case of the sheet supply cassette portion 50.

Further, the sliders 71, 72 are provided with guide rollers 110 rotatably mounted thereon, which guide rollers roll in the dovetail grooves 109 of the guide rails 105, 106 and 107, 108.

In the illustrated example, as shown in FIG. 14, each slider 71, 72 is guided and supported by three guide rollers 110 (upper one and lower two).

In FIG. 17, a ratchet portion 111 having a plurality of ratchet teeth on its peripheral surface is integrally formed with the roller shaft 97 of the sheet supply roller. On the other hand, a plate-shaped pawl portion 112 for abutting against the ratchet tooth of the ratchet portion 111 with a predetermined elastic force to lock the sliding contact roller 42 by engaging by the ratchet tooth is provided on the case of the sheet feeding apparatus 30 (the case of the sheet supply drive portion 40, in the illustrated embodiment). The ratchet portion 111 and the pawl portion 112 constitute a ratchet mechanism for preventing the reverse rotation of the sheet supply roller 41.

Figure 24:
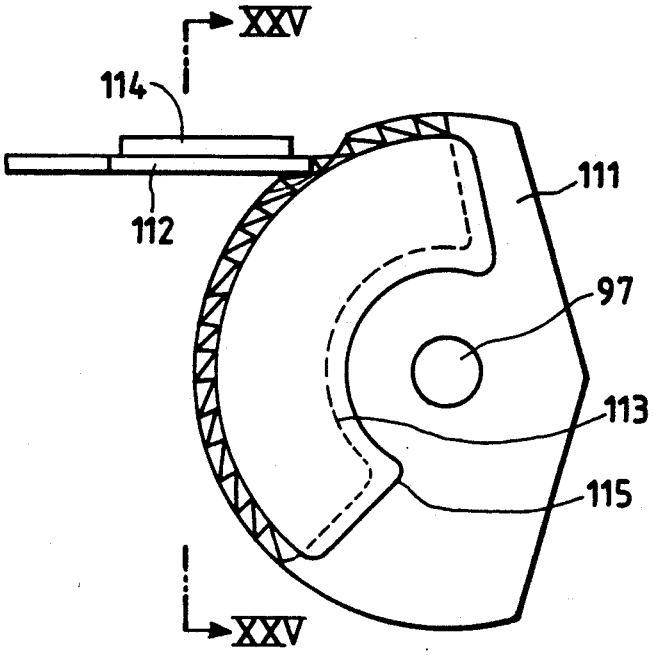
FIG. 24 is a partial side view showing a ratchet mechanism for a roller shaft of the sheet supply roller.
Figure 25:
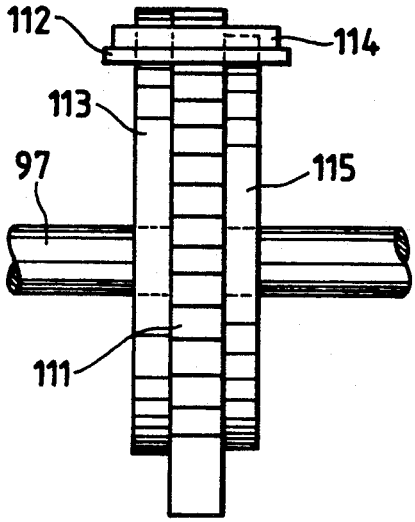
FIG. 25 is a partial sectional view taken along the line V V V—V V V of FIG. 24.

FIG. 24 is a partial side view showing the ratchet mechanism, and FIG. 25 is a sectional view taken along the line X X V—X X V in FIG. 24.

The reason for providing the ratchet mechanism for preventing the reverse rotation of the sheet supply roller is as follows:

In the sequence for heading the recording sheet 13 during the automatic sheet supplying operation, as mentioned above, after the recording sheet has once been inserted into the nip of the feed roller 14, the registration of the recording sheet is effected by rotating the feed roller 14 by the predetermined amount in the reverse direction. During the reverse rotation of the feed roller 14, since the clutch 98 is the one-way clutch, the sheet supply roller 41 becomes the clutch OFF condition.

However, if the sheet supply roller 41 is freely rotated during the registration of the recording sheet, the loop is not properly formed in the recording sheet 13, thus preventing the correct registration of the recording sheet.

Thus, in the sheet feeding apparatus 30 according to the present invention, by providing the ratchet mechanism 111, 112 for preventing the reverse rotation of the sheet supply roller, the reverse rotatin of the sheet supply roller is prevented during the registration of the recording sheet to easily form the proper loop in the recording sheet, thus performing the registration correctly. That is to say, the reason for providing the reverse rotation preventing mechanism is that the heading of the recording sheet can be effected correctly in the automatic sheet supplying operation.

On the other hand, while the feed roller 14 is being rotated normally during the heading of the recording sheet, i.e., while the clutch 98 is being in the ON condition to rotate the sheet supply roller 41 in the normal direction, the plate-shaped pawl portion 112 urged against the ratchet portion with the predetermined elastic force rides over the plural teeth (of the ratchet portion 111), thus generating the ratchet sliding noise.

To avoid this noise, as shown in FIGS. 24 and 25, the ratchet mechanism is provided with a silencer means for preventing the ratchet sliding noise. The silencer means comprises a vibration preventing soft rubber 113 attached to the side surface of the ratchet portion 111 by adhesive and the like, and a plate-shaped vibration preventing sheet 114 attached to the pawl portion 112 by adhesive and the like.

In the illustrated example, the vibration preventing rubber 113 extends near the tops of the teeth in order to enhance the silencer function and is elastically deformed when the pawl portion 112 penetrates into the space between the teeth of the ratchet.

To the contrary, if the vibration preventing rubber 113 extends up to the tops of the ratchet teeth, the pawl portion 112 will abut against the vibration preventing rubber 113, which often causes the unstable engagement between the pawl portion and the ratchet tooth.

To avoid this, a support member 115 made of relatively soft (for example, hardness of about 80 degrees) rubber (for example, urethane rubber) and having a predetermined thickness is attached to the side surface (opposite to the vibration preventing rubber 113) of the ratchet portion 112 in coincidence with the bottoms of the ratchet teeth by adhesive and the like.

By providing such support member 115, even when the vibration preventing soft rubber 113 extends up to the tops of the ratchet teeth, it is possible to stably engage the pawl portion 112 by the ratchet tooth, thus providing the reliable ratchet mechanism.

The silencer arrangement for the ratchet mechanism comprising the vibration preventing rubber 113 or the vibration preventing sheet 114, and the combination of such silencer arrangement and the ratchet stabilizing arrangement comprising the support member 115 can be applied to not only the reverse rotation preventing mechanism of the sheet feeding apparatus but also any ratchet mechanisms which has widely been used, with the same technical effect.

As mentioned above, according to the arrangement explained with reference to FIGS. 17, 24 and 25, there is provided a sheet feeding apparatus comprising a sheet supply roller 41 for feeding a loaded recording sheet 13, a driving force transmitting mechanism 33, 48, 93, 94, 95, 46, 96, 97 capable of driving the sheet supply roller 41 in synchronous with a feeding means of a recording system, a clutch 98 disposed in the driving force transmitting mechanism, and a reverse rotation preventing ratchet mechanism 111, 112 provided on a portion 97 rotated integrally with the sheet supply roller 41, whereby the registration of the recording sheet 13 during the sheet supplying operation can be effected easily and correctly.

In FIG. 17, a plurality (four in the illustrated embodiment) of sliding contact rollers 42 for guiding the automatically supplied recording sheet 13 are integrally formed with the roller shaft 47 driven in synchronous with the feed roller 14 via the gear 46.

Figure 26:
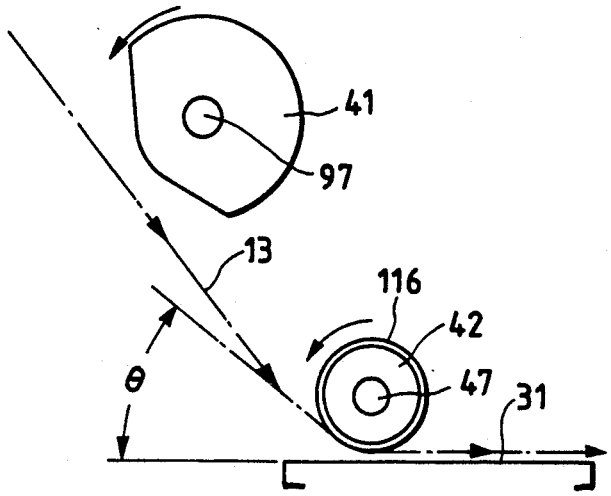
FIG. 26 is a partial side view showing a condition that the recording sheet is guided by a sliding contact roller.
Figure 27:
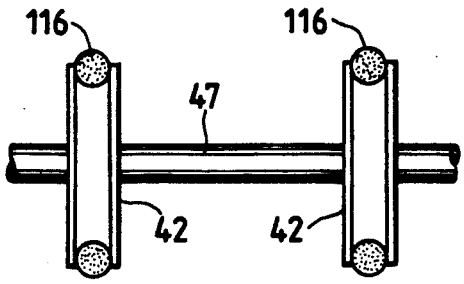
FIG. 27 is a sectional view of the sliding contact roller of FIG. 26.

FIG. 26 is a partial side view showing a condition that the recording sheet 13 is guided by the sliding contact rollers 42, and FIG. 27 is a vertical sectional view of the sliding contact rollers 42.

In FIGS. 26 and 27, the recording sheet 13 supplied by the sheet supply roller 41 enters into the sheet path surface 31 with a considerably great inclined angle $\theta$ (for example, 45–75 degrees). The sliding contact rollers 42 is disposed in the vicinity of the sheet path surface 31 so that they can surely feed the so entered recording sheet 13 into the recording system 10 through the sheet path surface. Now, a friction member 116 such as rubber is arranged around a peripheral surface of each sliding contact roller 42 to contact with the recording sheet 13.

Further, each sliding contact roller 42 is so designed that it guides the recording sheet 13 at a peripheral speed faster (for example, 6–10%) than that of the feed roller 14.

In the illustrated embodiment, the friction member 116 comprises an O-ring made of rubber and fitted on the peripheral surface of each sliding contact roller 42 (by adhesive, if necessary).

The friction member 116 may be made of rubber sheet or any other members having a relatively high coefficient of friction. As the rubber, for example, NBR, silicone rubber, urethane rubber or fluororubber is preferable.

With the arrangement of the sliding contact rollers 42 as mentioned above, it is possible to supply the recording sheet through the sheet path surface 31 (by omitting the normal fixed sheet guide) in both the automatic sheet supplying and manual sheet supplying operations, and, further, it is possible to reduce the back tension to the recording sheet effectively by increasing the feeding force for the recording sheet 13 during the automatic sheet supplying operation by the provision of the friction members 116.

Incidentally, if the back tension which resists to the feeding of the recording sheet 13 is too great, the discrepancy in the feeding of the sheet by means of the feed roller 14 will occur, thus causing the unevenness in the image on the sheet which results in the deterioration of the image quality. However, according to the above-mentioned arrangement of the present invention, since the friction forces of the sliding contact rollers 42 which slidingly contact the recording sheet at the faster peripheral speed (than that of the feed roller) are increased, it is possible to effectively reduce the back tension to prevent the discrepancy in the feeding of the sheet, thus improving the image quality obtained by the recording system 10.

As already explained with reference to FIGS. 12 and 13, in the sheet feeding apparatus 30, the sheet supply cassette portion 50 can be opened and closed with respect to the sheet supply drive portion 40.

When the sheet supply cassette portion 50 is in the closed position (preserved position shown in FIG. 3), after the ratch mechanism 89, 91 (FIG. 16) has been released by the push button 88, as the sheet supply cassette portion 50 is pivoted to the open position (usable position shown in FIG. 12), the shock will occur upon the stopage of the cassette portion due to the biasing force of the pressure spring 67 and the inertia force. Since the shock results in the reduction in the service life of the apparatus and the unreasonable noise, such shock should be avoided as long as possible.

Figure 28:
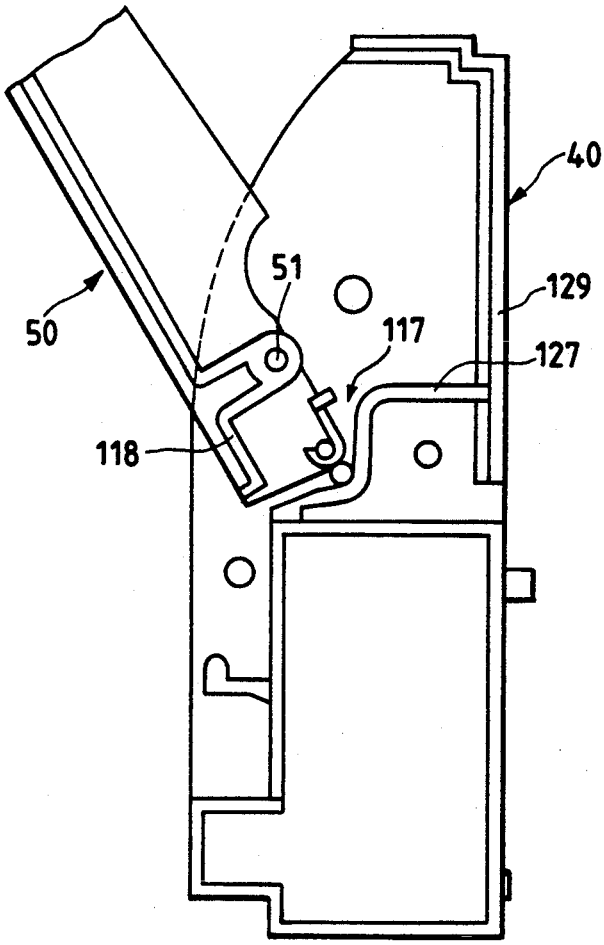
FIG. 28 is a side view showing a damper mechanism disposed between the sheet supply drive portion and the sheet supply cassette portion.
Figure 29:
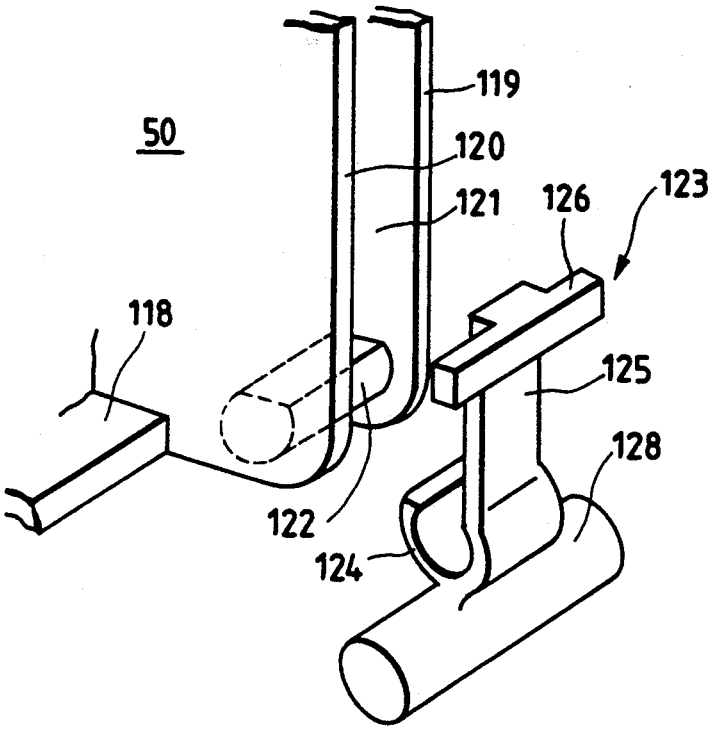
FIG. 29 is an exploded perspective view of the damper mechanism of FIG. 28 looked at from the sheet supply cassette side.

Thus, in the sheet feeding apparatus 30, there is provided a damper mechanism for relieving the shock occurred upon the opening of the sheet supply cassette portion 50. FIG. 28 is a side sectional view showing a damper mechanism 117 disposed between the sheet supply drive portion 40 and the sheet supply cassette portion 50, FIG. 29 is a partial exploded perspective view of the damper mechanism 117 of FIG. 28 locked at from a side of the sheet supply cassette portion 50, and FIG. 30 is a perspective view of the damper mechanism 117 of FIG. 28.

Figure 30:
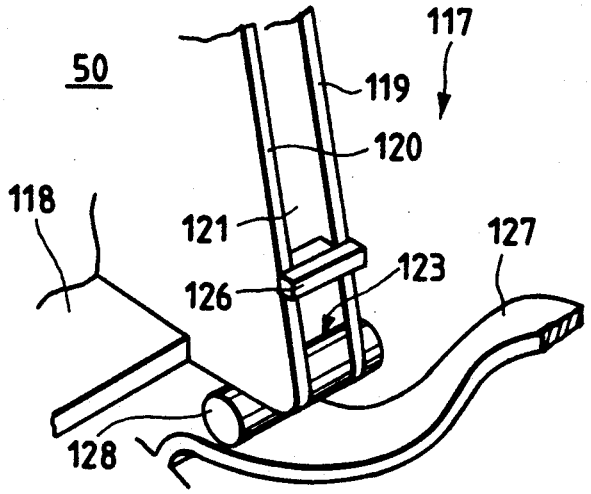
FIG. 30 is a schematic partial perspective view of the damper mechanism of FIG. 28.

In FIG. 30, on one end (for example, right end in FIG. 14) of a case 118 of the sheet supply cassette portion 50, a vertical rib 120 is arranged inside a wall portion 119 to form a vertical groove 121 therebetween, which groove opens at its front side and bottom side. A shaft member 122 extends horizontally between the rib and the wall portion at their lower ends across the vertical groove 121.

A sliding member 123 is fixedly attached in the vertical groove 121 via the shaft member 122 in non-rotational relation.

As shown in FIG. 30, the sliding member 123 comprises a curved or semi-cylindrical portion 124 fitted onto the shaft member 122 which is prevented from being detached from the shaft member by its own elastic force, a guide portion 125 fitted into the vertical groove 121, a rotation preventing portion 126 abutted against both front end surfaces (of the wall portion 119 and of the rib 120) on both sides of the groove 121, and a substantially cylindrical abutment sliding portion 128 capable of being abutted against an elastic rib 127 (FIGS. 28 and 30) of the sheet supply drive portion 40.

On the other hand, in the illustrated embodiment, the elastic rib 127 provided on the sheet supply drive portion 40 is integrally formed with a case 129 of the sheet supply drive portion 40 and has a side configuration as shown in FIG. 28. The elastic rib 127 is secured, at its both ends, to the case 129, and has a sectional shape which can be deformed when the abutment sliding portion 128 is urged against the elastic rib.

Incidentally, the abutment sliding portion 128 (sliding member 123) and the elastic rib 127 are preferably made of material having a relatively high coefficient of friction (generally, plastic); however, depending upon the urging force between these elements 128, 127 and the degree of deformation of these elements, it is not necessary to use the friction material for these elements, but the normal materials (plastic and the like) may be used. Further, the elastic rib 127 may be secured to the case 129 only at its one end, depending upon the configuration thereof.

Figure 31A:
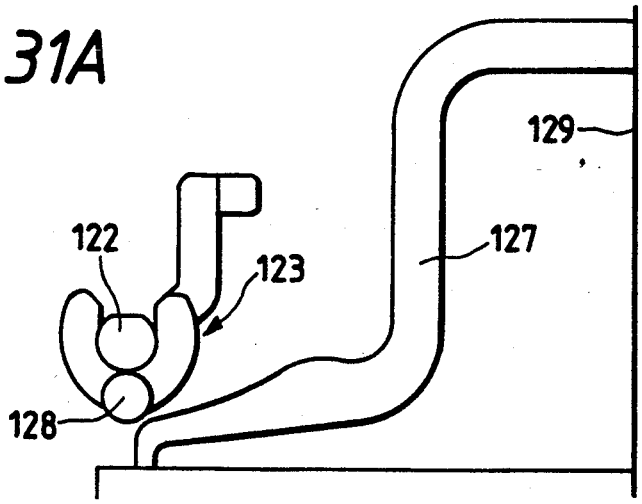
FIGS. 31A to 31C are partial side views for explaining the operation of the damper mechanism of FIG. 28.
Figure 31B:
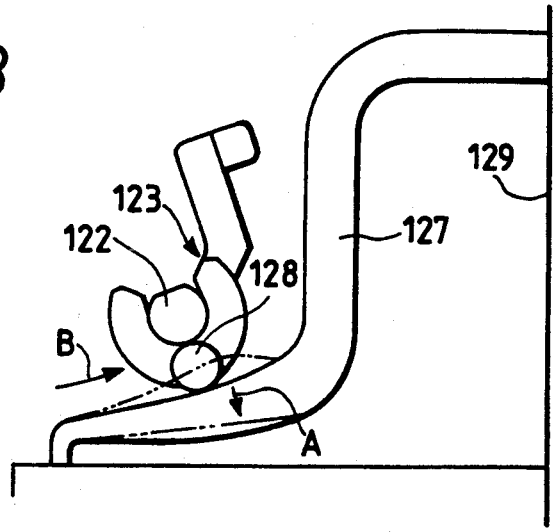
Figure 31C:
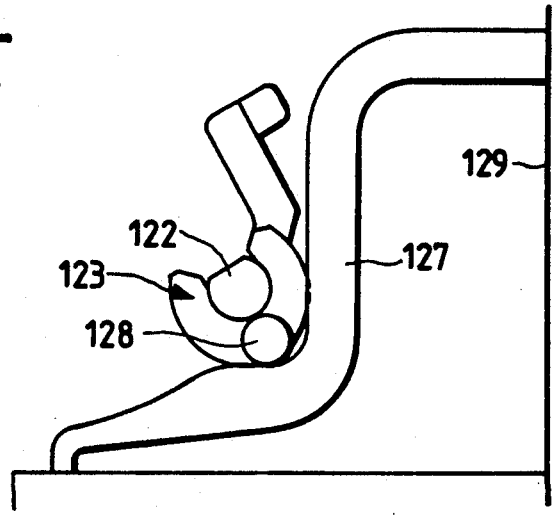

FIGS. 31A to 31C are explanatory views for explaining the damper action (shock absorbing action) by means of the sliding member 123 and the elastic rib 127.

FIG. 31A shows a condition that the sheet supply cassette portion 50 is closed (vertical position); in this condition, the sliding member 123 (abutment sliding portion 128) is spaced away from the elastic rib 127.

FIG. 31B shows a condition that the sliding member 123 is abutted against the elastic rib 127 to effect the damper action. That is to say, when the sheet supply cassette portion 50 is pivoted after the ratch mechanism is released, within a predetermined range on the way of the pivotal movement of the cassette portion, the sliding member 123 is abutted against the elastic rib 127. Then, the sliding member is being slid in a direction shown by the arrow B, while forcibly lowering the elastic rib in a direction shown by the arrow A to elastically deform the rib as shown. Due to such frictional sliding of the sliding member, the kinematic energy of the sheet supply cassette portion 50 is absorbed, thus effecting the damper function.

FIG. 31C shows a condition that the pivotal movement of the sheet supply cassette portion 50 is finished; in this condition, the urging force of the sliding member 123 is almost releaved, and thus, the elastic rib 127 returns to its original condition. In this way, after the condition shown in FIG. 31C is reached, the sheet supply cassette portion 50 is abutted against the stoppers 79

(FIG. 12), thus being held in the open position (inclined position in the automatic sheet supplying operation).

Incidentally, in the embodiments as mentioned above, while the damper mechanism which provides the mechanical sliding movement was used, in place of such damper mechanism, other kinds of dampers such as an oil damper utilizing the flow resistance of oil, a magnetic damper utilizing the electro-magnetic force and the like may be used with the same technical effect.

According to the damper mechanism explained with reference to FIGS. 28 to 31, since the damper 117 for absorbing the shock generated by the pivotal movement of the sheet supply cassette portion 50 is disposed between the sheet supply cassette portion and the sheet supply drive portion 40, it is possible to prevent the shock upon opening of the sheet supply cassette portion 50 and to prevent the wear and/or damage of the apparatus, thus improving the service life of the sheet feeding apparatus.

As shown in FIG. 17, at one side of the sheet supply drive portion 40, there is disposed the gear train 93, 94, 95, 46, 96 for transmitting the rotational force transmitted from the feed roller 14 of the recording system 10 to the driven gear 48, to the sheet supply roller 41 and the sliding contact rollers 42.

Figure 32:
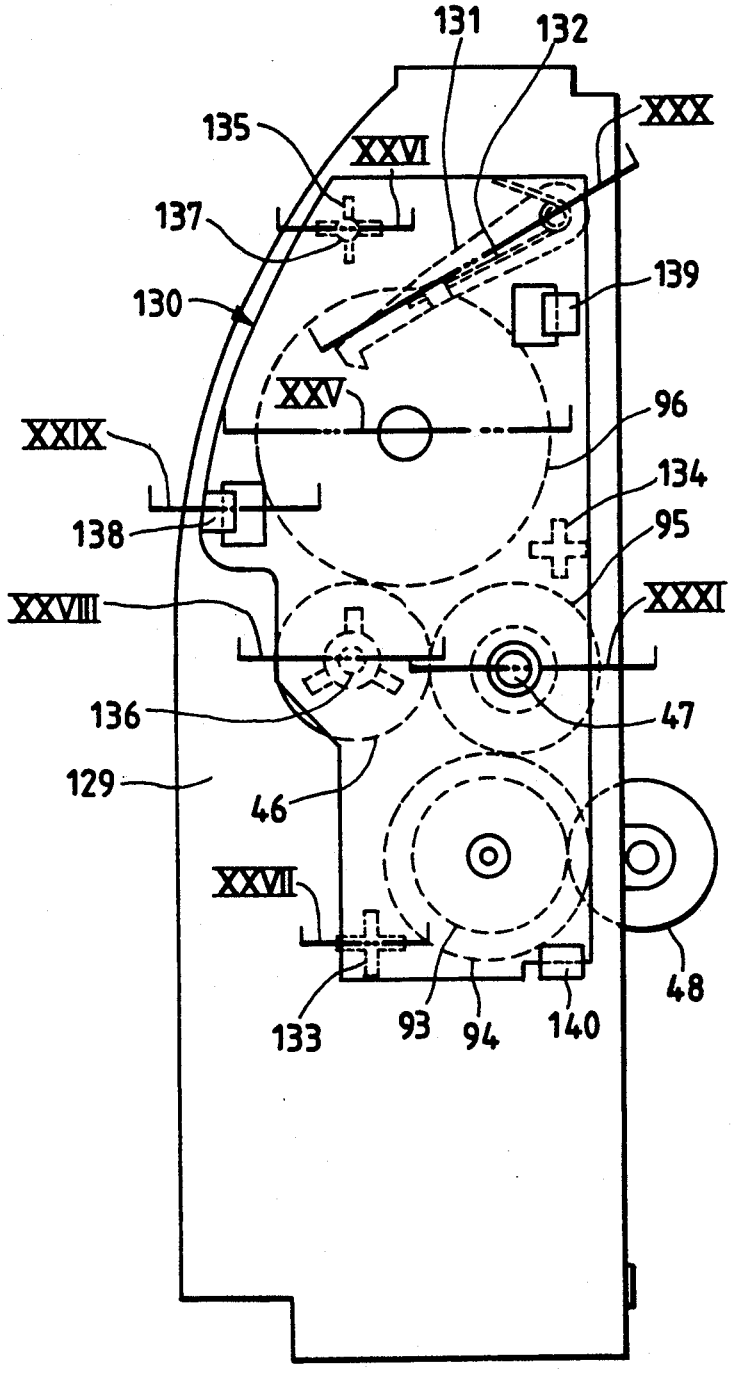
FIG. 32 is a side view showing a gear train and a bearing plate for rotatably supporting the gear train of FIG. 17.

FIG. 32 is a side view showing a condition that the gear train is rotatably supported by a bearing plate 130 at one side of the sheet supply drive portion 40.

In FIG. 32, the bearing plate 130 is formed from a plastic molded plate, by which the idler gears 93, 94, an end of the roller shaft 47 having the sliding contact roller gear 95, idler gear 46, and the sheet supply roller gear 96 connected to the roller shaft 97 of the sheet supply roller via the spring clutch (one-way clutch) 98 are rotatably supported, respectively.

Further, by the bearing plate 130, the control lever 131 for the spring clutch 98, and the control spring 132 for the control lever are prevented from being detached or dropped.

The bearing plate 130 is removably mounted and positioned with respect to the sheet supply drive portion 40 in the following manner: First of all, the bearing plate 130 is abutted against three abutments 133, 134, 135 formed on the case 129, thus regulating the lateral positions of the gears in the gear train. Further, the position of the bearing plate 130 in the left-and-right and up-and-down directions (FIG. 32) is regulated by two positioning fittings 136, 137.

Incidentally, one of the positioning fittings 136 is disposed at the same position as the abutment 135.

Then, the bearing plate 130 is snappingly fixed by means of three fixing pawls 138, 139, 140 formed on the case 129.

In this way, only by snappingly fixing the single bearing plate 130 to the case 129, it is possible to position the gears in the gear train and various rollers shafts and to prevent these elements from being detached, and also, it is possible to position the levers and bias springs (arranged near the bearing plate) and to prevent these elements from being detached.

FIGS. 33 to 39 are partial sectional views showing the concrete constructions of various elements shown in FIG. 32.

Figure 33:
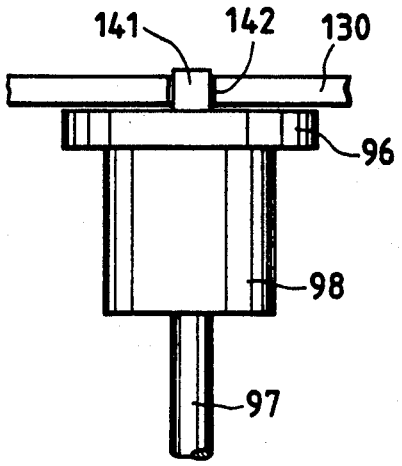
FIG. 33 is a sectional view taken along the line X X V—X X V in FIG. 32.

FIG. 33 shows a bearing arrangement for the sheet supply roller gear 96 taken along the line X X V—X X V in FIG. 32, where the gear 96 connected to the roller shaft 97 of the sheet supply roller via the spring clutch (one-way clutch) 98 is positioned and is prevented from being detached, by fitting a roller shaft 141 of the gear 96 into a bearing hole 142 formed in the bearing plate 130.

Figure 34:
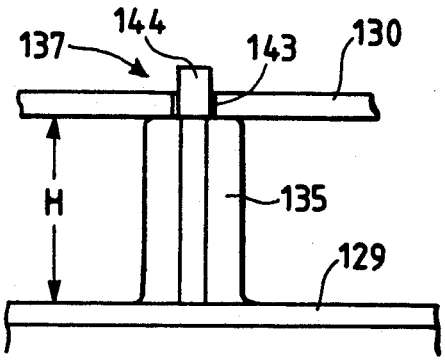
FIG. 34 is a sectional view taken along the line X X VI—X X VI in FIG. 32.

FIG. 34 shows the arrangement of the abutment 135 and the positioning fitting 137 taken along the line X X VI—X X VI in FIG. 32, where an elongated slot 143 connecting the fitting 137 to the other fitting 136 is formed in the bearing plate 130. By fitting the elongated slot onto an end shaft of the abutment 135 of the case 129 and by abutting the bearing plate 130 against the end surface of the abutment 135, the position of the bearing plate 130 in the left-and-right direction (FIG. 27) is regulated and the distance H between the bearing plate and the case 129 is also regulated.

Figure 35:
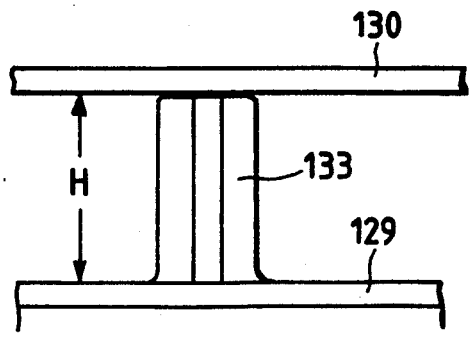
FIG. 35 is a sectional view taken along the line X X VII—X X VII in FIG. 32.

FIG. 35 shows the arrangement of the abutment 133 taken along the line X X VII—X X VII in FIG. 32, where, by abutting the bearing plate 130 against the end surface of the abutment 133, the distance H between the bearing plate and the case 129 is regulated.

Incidentally, the abutment 134 shown in FIG. 32 has the same construction and size as those of the abutment 133.

Accordingly, the distance H between the bearing plate 130 and the case 129 is correctly regulated by abutting the bearing plate against the three abutments 133, 134 and 135.

Figure 36:
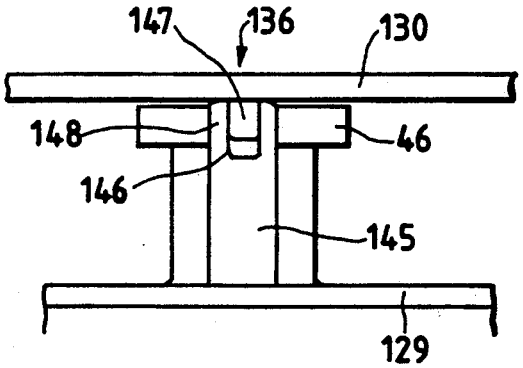
FIG. 36 is a sectional view taken along the line X X VIII—X X VIII in FIG. 32.

FIG. 36 shows the arrangement of the positioning fitting 136 for the bearing plate 130 taken along the line X X VIII—X X VIII in FIG. 32, where a fitting hole 146 is formed in an end surface of a stepped boss portion 145 formed on the case 129. By fitting a projection 147 formed on the back surface of the bearing plate 130 into the fitting hole 146, the position of the bearing plate 130 in the left-and-right and up-and-down directions is regulated. Thus, the position of the bearing plate 130 in the rotational, left-and-right and up-and-down directions is regulated by the two positioning fittings 137, 136.

Incidentally, the idler gear 46 is rotatably mounted on a shaft portion 148 of the stopped boss portion 145, and, thus, the positioning fitting 136 of FIG. 36 also acts as a means for preventing the idler gear 46 from being detached.

Figure 37:
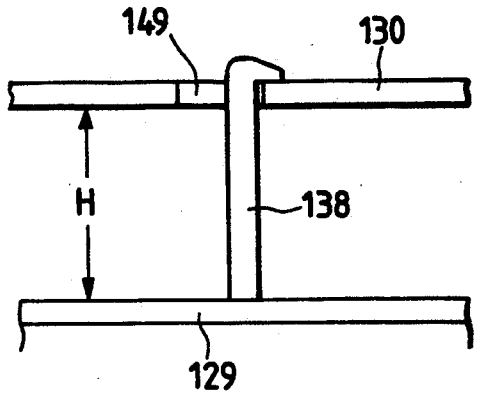
FIG. 37 is a sectional view taken along the line X X IX—X X IX in FIG. 32.

FIG. 37 shows the engaging arrangement of the fixing pawl 138 taken along the line X X IX—X X IX in FIG. 32, where the fixing pawl 138 formed on the case 129 can be elastically deformed in a bending direction. By snap fitting the fixing pawl 138 as shown through an opening or notch 149 formed in the bearing plate 130, the latter is fixed at a predetermined position.

The other two fixing pawls 139, 140 have substantially the same engaging arrangements as that of the fixing pawl 138 of FIG. 37, and, thus, the bearing plate 130 is fixed to the case 129 at the predetermined position (distance between the bearing plate and the case is H) by the three fixing pawls 138, 139 and 140.

Figure 38:
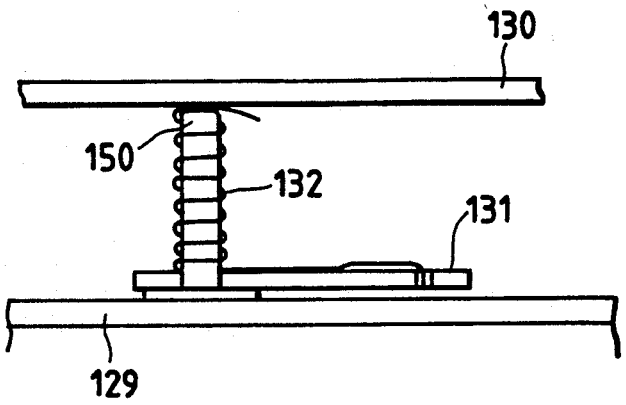
FIG. 38 is a sectional view taken along the line X X X—X X X in FIG. 32.

FIG. 38 shows the arrangement for preventing the control lever 131 and the spring 132 from being detached, taken along the line X X X—X X X in FIG. 32, where the control lever 131 and the torsion spring 132 are mounted on a shaft portion 150 formed on the case 129. By fixing the bearing plate 130 at the predetermined position (distance between the bearing plate and the case is H), the control lever 131 and the control spring 132 are held at predetermined positions and are prevented from being detached.

Incidentally, the control lever 131 and the control spring 132 serve to control one revolution of the spring clutch (one-way clutch) 98 provided on the roller shaft 97 of the sheet supply roller (i.e., control the heading of the recording sheet 13).

Figure 39:
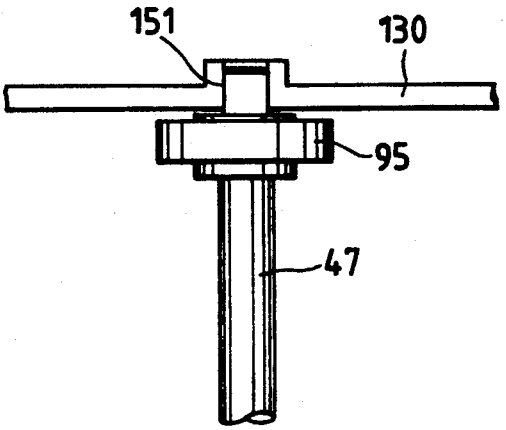
FIG. 39 is a sectional view taken along the line X X XI—X X XI in FIG. 32.

FIG. 39 shows the bearing arrangement for the roller shaft 47 of the sliding contact roller 42 taken along the line X X XI—X X XI in FIG. 32, where the sliding contact roller gear 95 is integrally attached to the roller shaft 47, and one end of the roller shaft 47 is rotatably received in a bearing hole 151 formed in the bearing plate 130.

With the arrangement shown in FIG. 39, the roller shaft 47, and accordingly, the sliding contact rollers 42 and the sliding contact roller gear 95 provided on the roller shaft are positioned, rotatably supported and prevented from being detached.

According to the bearing arrangement for the gear train explained with reference to FIGS. 32–39, there is provided a sheet feeding apparatus 30 which can be removably mounted on the recording system 10 and has a gear train for transmitting the driving force from a feed roller 14 of the recording system 10 to a sheet supply roller 41 and sliding contact rollers 42 and wherein, by providing a single bearing plate 130 snappingly fixed to a case of the apparatus, gears in the gear train can be positioned and be prevented from being detached and rollers 41, 42, lever 131 and spring 132 can also be positioned and be prevented from being detached.

According to such bearing arrangement, by using a single bearing plate 130, it is possible to easily assemble a plurality of constructural elements such as gears and rollers with a fewer parts in a simple manner and with high accuracy and to make the apparatus compact by reducing the module of the gear train.

Figure 40:
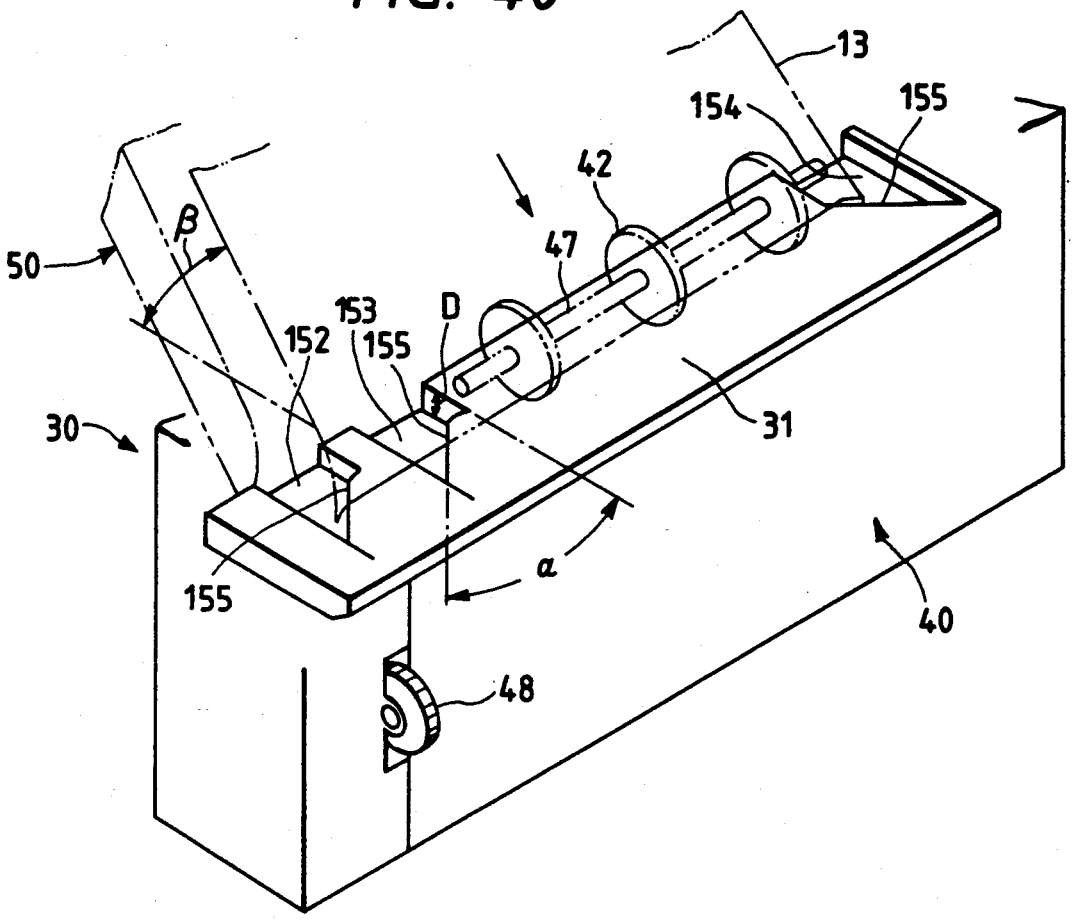
FIG. 40 is a partial perspective view of a sheet path surface of the sheet feeding apparatus of FIG. 12.

FIG. 40 is a partial perspective view showing the arrangement of the sheet path surface 31 (FIG. 1 or FIG. 12).

In FIG. 40, on both sides of the sheet path surface 31, i.e., at positions corresponding to both edges of the recording sheet 13 to be supplied, recesses 152, 153, 154 are formed.

At the left in FIG. 40, two recesses 152, 153 are formed, and a single recess 154 is formed at the right in FIG. 40, since the left and right recesses 153, 154 correspond to the width of a recording sheet having B4 size and the left and right recesses 152, 154 correspond to the width of a recording sheet having A4 size so that recording sheets having various widths can be handled. Each recess 152–154 has an inclined portion 155 diverging outwardly of the width of the recording sheet as it goes downstream in the sheet feeding direction.

Although these inclined portions 155 can be provided at the whole area of each recess in the sheet feeding direction, they may be provided partially at only areas below the sliding contact rollers 42, as shown.

Further, an inclined angle of each inclined portion 155 is selected in a range, for example, from about 30 degrees to about 60 degrees. In addition, depths of the recesses 152, 153, 154 can be selected to have a value of about 4 mm, for example.

Further, an upper edge of each inclined portion 155 is chamfered to provide a smooth arcuated curve.

Incidentally, in the illustrated sheet feeding apparatus 30, the sheet path surface 31 is formed substantially horizontally so that the recording sheet 13 from the sheet supply cassette portion 50 can enter into the sheet path surface 31 with a considerable large angle $\beta$ (for example, about 50–70 degrees). The reason for setting the large angle $\beta$ is that, as can be understood from FIG. 1, when the sheet path surface is mounted on the sheet feeding apparatus 30 or the recording system 10, the whole construction becomes small-sized.

According to the arrangement of the sheet path surface 31 as mentioned above, even if the front corners of the supplied recording sheet 13 is bent downwardly or even if the introduction angle $\beta$ of the recording sheet 13 with respect to the sheet path surface 31 is great, it is possible to prevent the folding and/or jamming of the recording sheet and to always guide the recording sheet 13 smoothly, thus supplying the sheet to the recording system 10 correctly.

Further, as mentioned above, since the introduction angle 8 of the recording sheet 13 can be great, it is possible to make the sheet feeding apparatus 30 small-sized, thus permitting the apparatus to become compact and light-weighted.

Figure 41:
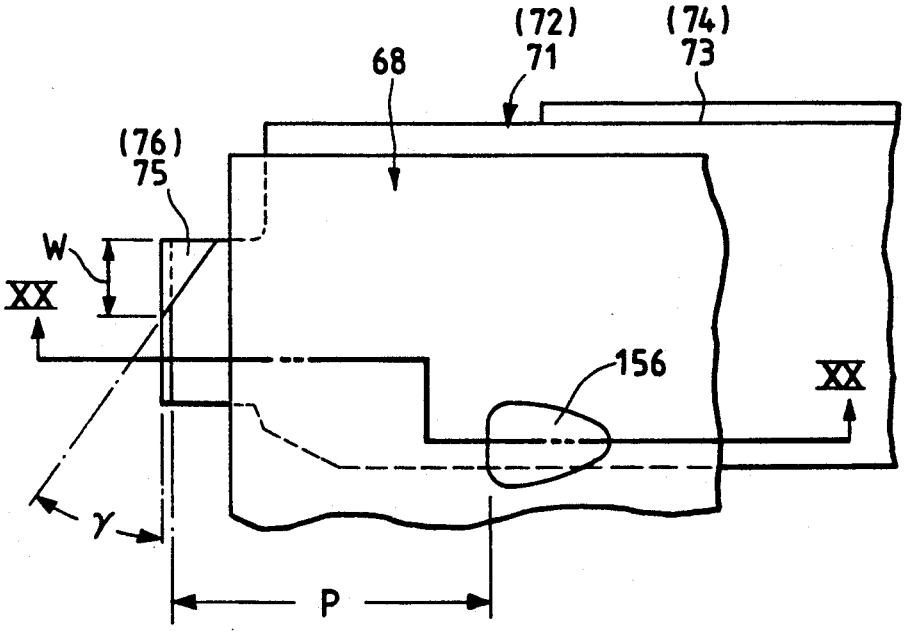
FIG. 41 is a partial plan view showing a pressure plate and a separating pawl of FIG. 12.

FIG. 41 is a partial plan view showing the separating pawl 75 fixedly attached to the slider 71 and the pressure plate 68 for abutting the leading end of the loaded recording sheet 13 against the separating pawl 75.

Figure 42A:
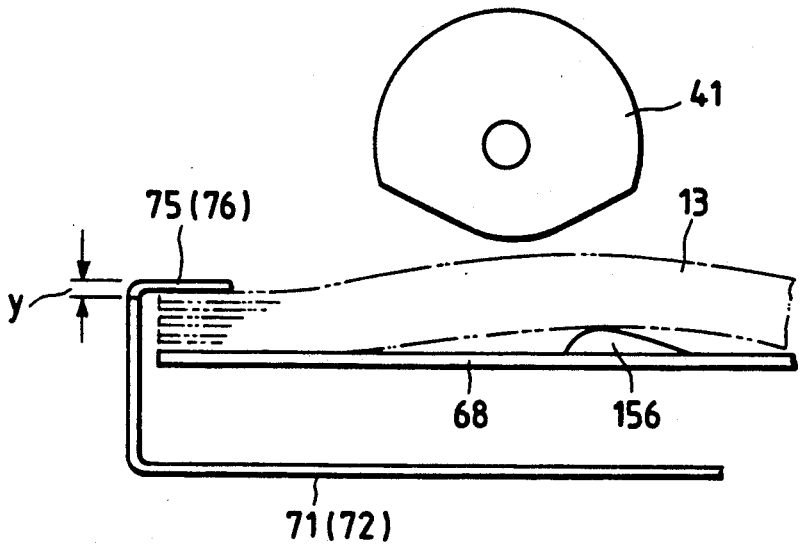
FIGS. 42A and 42B are partial elevational sectional views taken along the line X X—X X of FIG. 41, showing a waiting condition and a condition that the pressure plate is lowered, respectively.
Figure 42B:
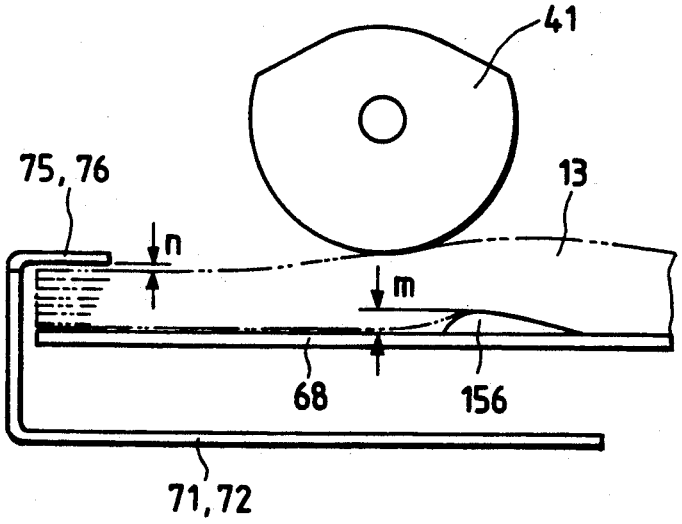

FIGS. 42A and 42B are elevational sectional views taken along the line X X—X X in FIG. 19, where FIG. 42A shows a condition that the sheet supply roller 41 is spaced apart from the recording sheet 13 and FIG. 42B shown a condition that the sheet supply roller 41 pushes down the recording sheets 13.

Figure 43A:
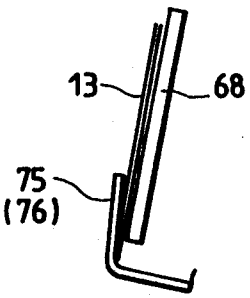
FIGS. 43A to 43F are partial elevational sectional views for explaining a condition that the sheets are being separated by the mechanism of FIG. 41.
Figure 43B:
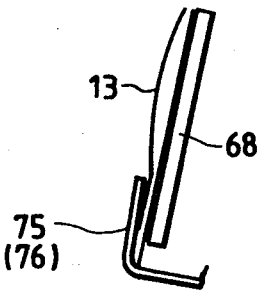

In FIGS. 41, 42A and 43B, the separating pawl 75 is fixedly mounted on the slider 71 to be shifted therewith in the transverse direction (widthwise) of the recording sheet, but is not influenced upon the movement of the pressure plate 68 toward and away from the sheet supply roller 41. The other separating pawl 76 is fixedly mounted on the other slider 72 and constitutes a fixed separating pawl similar to the separating pawl 75.

A projection 156 cooperating with the separating pawl 75 is formed on the pressure plate 68. Another projection 156 is similarly formed on the pressure plate 68 to cooperate with the separating pawl 76.

That is to say, the left and right projections 156 on the pressure plate 68 are disposed at positions rearwardly of the separating pawls 75, 76 by predetermined distances, where, by lifting the intermediate portion of the recording sheet by a predetermined amount, the proper loop can be formed in the sheet rearwardly of the separating pawls 75, 76 during the automatic sheet supplying operation.

In FIG. 42B, a height m of each projection 156 is selected to be the same as or greater than a depressed amount n of the recording sheets 13 by means of the sheet supply roller 41 during the automatic sheet supplying operation. For example, when the maximum depressed amount n (by means of the sheet supply roller 41) is 0.8–1.5 mm, the height m of each projection is selected to have a value of about 0.8–2.5 mm, for example, which is greater than the value n.

Further, an inclined angle of a pawl portion of each separating pawl 75, 76 is generally about 45 degrees, and, for example, is selected to have a value of about 30–60 degrees, and a width w of each separating pawl is selected to have a value of about 10 mm, for example. A distance P between each projection 156 and the corresponding separating pawl 75, 76 in the front-and-rear direction can be selected to have a value of about 20 mm, for example, and, the positions of the projections 156 in the transverse direction are set to be inwardly of the separating pawls 75, 76 by a predetermined distance.

Further, since the separating pawls 75, 76 are of the fixed type, these can be made of a relatively thin metal plate (stainless steel and the like), and, for example, can be made of a steel plate having a thickness of about 0.5 mm.

Furthermore, a hight difference y between the pawl portion 157 of each separating pawl 75, 76 and a shelf portion 158 can easily be small (for example, about 0.5 mm), since the thickness of the metal plate is small. By making the height difference y smaller, it is possible to quicken the separating timing of the recording sheet 13.

FIGS. 43A to 43F are explanatory views for explaining a condition that the recording sheet 13 is separated and supplied by means of the separating pawls 75, 76 and the pressure plate 68.

FIG. 43A shows a condition prior to the initiation of the sheet supplying operation, where the pressure plate 68 is in a raised position to urge the leading ends of the loaded recording sheets 13 against the separating pawls 75 (76). Further, the intermediate portions of the recording sheets 13 are curved upwardly by means of the projections 156.

Figure 43C:
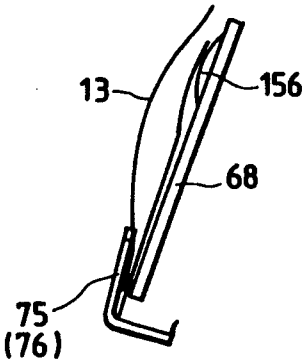

FIG. 43B shows a condition upon initiation of the sheet supply operation, where the depressed amount of the pressure plate 68 is slight and the loop starts to be formed in the recording sheet 13 between the projections 156 and the separating pawls 75 (76). FIG. 43C shows a condition that the formation of the loop is further continued as the sheet supply roller 41 is rotated. In this case, the depressed amount of the pressure plate 68 is gradually increased, depending upon the configuration of the sheet supply roller 41.

Figure 43D:
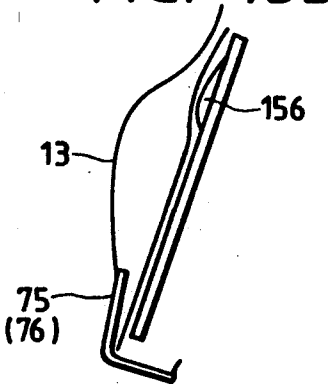

FIG. 43D shows a condition at a moment when the leading end of the recording sheet looped and separated rides on the upper surfaces of the separating pawls 75 (76).

Figure 43E:
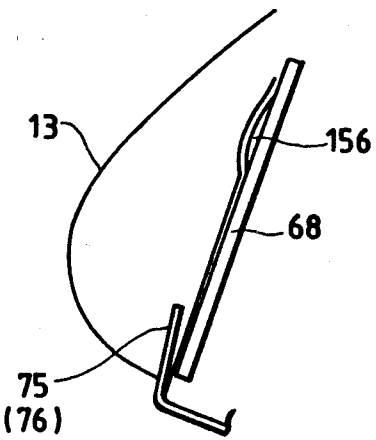

FIG. 43E shows a condition that the separated recording sheet is sliding on the upper surfaces of the separating pawls 75 (76) and the loop is substantially maximum. In this case, although the pressure plate 68 is depressed considerably by means of the sheet supply roller 41, the maximum depressed amount has not yet been reached.

Figure 43F:
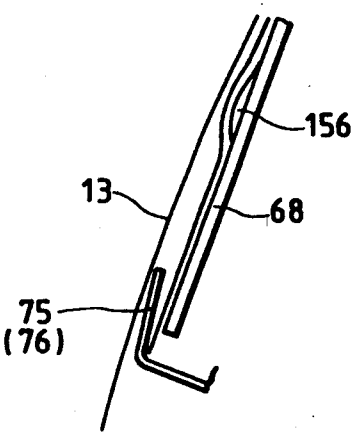

FIG. 43F shows a condition that the separation of the recording sheet is completed and the separated sheet starts to be supplied by means of the sheet supply roller 41. In this point, the depressed amount of the pressure plate 68 by means of the sheet supply roller 41 becomes maximum, and, accordingly, a clearance between the loaded recording sheets 13 and the separating pawls 75 (76) also becomes maximum.

With this arrangement, there is provided a sheet feeding apparatus wherein recording sheets 13 stacked on a pressure plate 68 biased by a spring 67 are separated and supplied one by one to the recording system by the combination of a sheet supply roller 41 applying a sheet feeding force to the recording sheet and separating pawls 75, 76 and wherein a fixed type separating pawls are used as the separating pawls 75, 76 and projections 156 for lifting intermediate portions of the recording sheets 13 by a predetermined amount m are disposed on the pressure plate 68 rearwardly of the separating pawls by predetermined distances.

According to such arrangement, it is possible to reduce the clearance between the recording sheets 13 and the separating pawls 75, 76 in lowering the recording sheets 13 by means of the sheet supply roller 41 during the automatic sheet supplying operation, and, thus, to easily form the stable and proper loop in the leading end portion of the recording sheet 13 during the sheet supply, thus separating the recording sheet correctly.

Further, since the fixed type separating pawls having a fewer parts and a simple construction can be used in place of any movable type separating pawls without deterioration of the separating ability, it is also possible to make the sheet feeding apparatus compact and inexpensive.

Incidentally, as the recording system 10, a serial type recording system wherein a recording head is mounted on a carriage shiftable along the recording sheet, a line type recording system using a recording head covering a recording area transversely of the recording sheet, or any other recording system can be used.

Further, as the recording system 10, a color recording system having plural color recording heads, a stepped color recording system using a plurality of recording heads each including the same color but different density ink, or any other recording system having any numbers of recording head, rather than a single recording head, can be used.

Among various recording methods, the present invention is effectively applied to a recording system utilizing an ink jet recording method.

Preferably, the typical construction and principle thereof can be realized by using the fundamental principles, for example, disclosed in U.S. Pat. Nos. 4,723,129 and 4,740,796.

Although this system can be applied to both a so-called "on-demand type" and "continuous type", it is more effective when the present invention is particularly applied to the on-demand type, because, by applying at least one drive signal corresponding to the record information and capable of providing the abrupt temperature increase exceeding the nucleate boiling to the electrical/thermal converting elements arranged in correspondence to the sheet or liquid passages including the liquid (ink) therein, it is possible to form a bubble in the liquid (ink) in corresponding to the drive signal by generating the film boiling on the heat acting surface of the recording head due to the generation of the thermal energy in the electrical/thermal converting elements.

Due to the growth and contraction of the bubble, the liquid (ink) is discharged from the discharge opening to form at least one ink droplet.

When the drive signal has a pulse shape, since the growth and contraction of the bubble can be quickly effected, more excellent ink discharge is achieved. Such pulse-shaped drive signal may be ones disclosed in U.S. Pat. Nos. 4,463,359 and 4,345,262.

Incidentally, by adopting the condition disclosed in U.S. Pat. No. 4,313,124 providing the invention regarding the temperature increasing rate on the heat acting surface, a further excellent recording can be performed.

As the construction of the recording head, the present invention includes the construction wherein the heat acting portion is disposed in an arcuate area as disclosed in U.S. Pat. Nos. 4,558,333 and 4,459,600, as well as the constructions wherein the discharge openings, liquid paths and electrical/thermal converting elements are combined (straight liquid paths or orthogonal liquid paths).

In addition, the present invention can applicable to the construction wherein each discharge opening is constituted by a slit with which a plurality of electrical/thermal converting elements associated in common as disclosed in the Japanese Patent Laid-Open No.

59-123670 and the construction wherein openings for absorbing the pressure wave of the thermal energy are arranged in correspondence to the discharge openings as disclosed in the Japanese Patent Laid-Open No. 59-138461.

Further, as a recording head of full-line type having a length corresponding to a maximum width of a recording medium to be recorded, the construction wherein such length is attained by combining a plurality of recording heads or a single recording head integrally formed may be adopted to the present invention, with more excellent technical advantages.

In addition, the present invention is effectively applicable to a removable recording head of chip type wherein, when mounted on the recording system, electrical connection between it and the recording system and the supply of ink from the recording system can be permitted, or to a recording head of cartridge type wherein a cartridge is integrally formed with the head.

Further, it is preferable that a head recovering means and an auxiliary aiding means are added to the recording head according to the present invention, since the effect of the present invention is further improved.

More concretely, these means include a capping means for capping the recording head, cleaning means, pressurizing or suction means, and an auxiliary heating means comprising electrical/thermal converters or other heating elements or the combination thereof. Further, it is effective for the stable recording to perform an auxiliary discharge mode wherein the ink discharge regardless of the recording ink discharge is effected.

Further, as the recording mode of the recording system, the present invention can effectively be applied not only to a recording mode with a single main color such as black, but also to a system providing a plurality of different colors and/or a full-color by mixing colors by using an integrated recording head or the combination of plural recording heads.

In the illustrated embodiments, while the ink was liquid, the ink may be solid in a room temperature or may be softened at a room temperature.

In the above-mentioned ink jet recording system, since the temperature control is generally effected in a temperature range from 30° C. to 70° C. so that the viscosity of the ink is maintained within a stable discharging range, the ink may be liquidized when the record signal is emitted.

In addition, ink having a feature that is firstly liquidized by the thermal energy, such as solid ink which serves to prevent the increase in temperature by absorbing energy in changing the ink from the solid state to the liquid state or which is in the solid state in the preserved condition to prevent the vaporization of ink and which is liquidized into ink liquid to be discharged in response to the recording signal comprising the thermal energy, or ink which has already been solidified upon reaching the recording medium, can also be applied to the present invention.

In such a case, the ink can be held in, the liquid state or solid state in recesses or holes in porous sheet as disclosed in the Japanese Patent Laid-Open Nos. 54-56847 and 60-71260, in confronting relation to the electrical/thermal converters.

In the present invention, for the above-mentioned inks, the most effective result can be obtained by performing the above-mentioned film boiling principle.

What is claimed is:

1. A sheet feeding apparatus comprising:

sheet containing means for supporting sheets therein;

sheet supply means for feeding out a sheet from said sheet containing means;

a path surface disposed along a sheet feeding path in a direction transverse to a sheet feeding direction of the sheet fed by said sheet supply means for deflecting the sheet;

rotary feeding means disposed away from said path surface for applying a feeding force to the sheet by slidingly contacting the sheet deflected by said path surface; and conveying means, disposed downstream of said rotary feeding means for conveying the sheet, wherein peripheral speed of said rotary feeding means is faster than a conveying speed of said conveying means.

2. A sheet feeding apparatus according to claim 1, wherein the whole of said rotary feeding means or a portion of said rotary feeding means which slidingly contacts the sheet is made of material having a relatively high coefficient of friction.

3. A sheet feeding apparatus according to claim 1, wherein said rotary feeding means comprises a sliding contact roller.

4. A sheet feeding apparatus according to claim 3, wherein a member having a relatively high coefficient of friction is mounted on a peripheral surface of said sliding contact member.

5. A sheet feeding apparatus according to claim 1, wherein said path surface comprises a flat surface.

6. A sheet feeding apparatus according to claim 5, wherein the sheet fed from said sheet supply means is deflected by said path surface by an angle of about 45–75 degrees with respect to said sheet feeding direction.

7. A sheet feeding apparatus according to claim 1, wherein said rotary feeding means and said sheet supply means are driven by a same drive source.

8. A sheet feeding apparatus comprising:

sheet containing means for supporting sheets therein;

sheet supply means for feeding out a sheet from said sheet containing means;

a path surface disposed along a sheet feeding path in a direction transverse to a sheet feeding direction of the sheet fed by said sheet supply means for deflecting the sheet;

rotary feeding means disposed away from said path surface for applying a feeding force to the sheet by slidingly contacting the sheet deflected by said path surface;

manual sheet supply means for manually supplying the sheet between said path surface and said rotary feeding means; and conveying means, disposed downstream of said rotary feeding means for conveying the sheet, wherein peripheral speed of said rotary feeding means is faster than a conveying speed of said conveying means.

9. A sheet feeding apparatus according to claim 8, wherein said manual sheet supply means comprises a manual sheet insertion opening, and a tray disposed in the vicinity of said insertion opening.

10. A sheet feeding apparatus according to claim 8, wherein said rotary feeding means serves to apply the feeding force to the sheet fed from said sheet containing means and to guide the sheet inserted by said manual sheet supply means.

11. A sheet feeding apparatus according to claim 8, wherein the whole of said rotary feeding means or a portion of said rotary feeding means which slidingly contacts the sheet is made of material having a relatively high coefficient of friction.

12. A sheet feeding apparatus according to claim 8, wherein said rotary feeding means comprises a sliding contact roller.

13. A sheet feeding apparatus according to claim 12, wherein a member having a relatively high coefficient of friction is mounted on a peripheral surface of said sliding contact roller.

14. An image forming system comprising:

sheet containing means for supporting sheets therein;

sheet supply means for feeding out a sheet from said sheet containing means;

a path surface disposed along a sheet feeding path in a direction transverse to a sheet feeding direction of the sheet fed by said sheet supply means for deflecting the sheet;

rotary feeding means, disposed away from said path surface, for applying a feeding force to the sheet by slidingly contacting the sheet deflected by said path surface; and image forming means, disposed downstream of said rotary feeding means, for forming an image on the sheet while conveying it, wherein peripheral speed of said rotary feeding means is faster than a conveying speed of said image forming means.

15. An image forming system according to claim 14, wherein said image forming means includes a feed roller, and wherein a sheet feeding speed of said feed roller is selected slower than that of said rotary feeding means.

16. An image forming system according to claim 15, further including a driving force transmitting means for transmitting a driving force from a drive source for driving said feed means to said rotary feeding means and said sheet supply means.

17. An image forming system according to claim 14, wherein the whole of said rotary feeding means or a portion of said rotary feeding means which slidingly contacts the sheet is made of material having a relatively high coefficient of friction.

18. An image forming system according to claim 14, wherein said rotary feeding means comprises a sliding contact roller.

19. An image forming system according to claim 18, wherein a member having a relatively high coefficient of friction is mounted on a peripheral surface of said sliding contact roller.

20. An image forming system according to claim 14, wherein said sheet containing means, said sheet supply means and said path surface constitute a sheet supply portion separate from said image forming means, and further including a connection means for removably mounting said sheet supply portion on said image forming means.

21. An image forming system according to claim 20, wherein said sheet supply portion is mounted on said image forming means in such a manner that a longitudinal direction of said sheet supply portion is directed vertically.

22. An image forming system according to claim 14, wherein said image forming means utilizes an ink jet recording method for forming the image by discharging ink by using thermal energy generated by electrical/-thermal converters.

23. An image forming system according to claim 14, wherein said image forming means utilizes an ink jet recording method for forming the image by discharging ink by the growth of a bubble generated by the heating exceeding nucleate boiling by means of electrical/thermal converters.

24. A sheet feeding apparatus according to claim 1, wherein said sheet containing means comprises a pressure plate for urging the sheets stacked therein against said sheet supply means and separation pawls for separating the sheet to be fed, and said sheet feeding apparatus further comprises a protrusion for lifting the sheet by a predetermined amount.

25. A sheet feeding apparatus comprising:

sheet containing means for supporting sheets therein;

sheet supply means for feeding out a sheet from said sheet containing means;

a path surface disposed along a sheet feeding path in a direction transverse to a sheet feeding direction of the sheet fed by said sheet supply means for deflecting the sheet;

recessed portions, formed on said path surface, each of said recessed portions having an inclined portion diverging outwardly of the width of the sheet as it travels downstream in the sheet feeding direction; and rotary feeding means disposed away from said path surface for applying a feeding force to the sheet by slidingly contacting the sheet deflected by said path surface.

26. An image forming apparatus comprising:

a sheet containing means for supporting sheets therein;

sheet supply means for feeding out a sheet from said sheet containing means;

a path surface disposed along a sheet feeding path in a direction transverse to a sheet feeding direction of the sheet fed by said sheet supply means for deflecting the sheet;

recessed portions forming said path surface, each of said recessed portions having an inclined portion diverging outwardly of the width of the sheet as the sheet travels downstream in the sheet feeding direction;

rotary feeding means disposed away from said path surface for applying a feeding force to the sheet by slidingly contacting the sheet deflected by said path surface; and image forming means, disposed downstream of said rotary feeding means, for forming an image on the sheet while conveying it.

27. An image forming apparatus comprising:

sheet containing means for supporting sheets therein;

sheet supply means for feeding out a sheet from said sheet containing means;

a path surface disposed along a sheet feeding path in a direction transverse to a sheet feeding direction of the sheet fed by said sheet supply means for deflecting the sheet;

rotary feeding means disposed away from said path surface for applying a feeding force to the sheet by slidingly contacting the sheet deflected by said path surface;

manual sheet supply means for manually supplying the sheet between said path surface and said rotary feeding means;

conveying means, disposed downstream of said rotary feeding means for conveying the sheet; and image forming means, disposed downstream of said rotary feeding means, for forming an image on the sheet while conveying it, wherein the peripheral speed of said rotary feeding means is faster than a conveying speed of said conveying means.

* * * * *

UNITED STATES PATENT AND TRADEMARK OFFICE

CERTIFICATE OF CORRECTION

PATENT NO. : 5,238,235

DATED : August 24, 1993

INVENTOR(S) : Tetsuhiro NITTA, et al.

It is certified that error appears in the above-indentified patent and that said Letters Patent is hereby corrected as shown below:

On the Title Page

[56] U.S. PATENT DOCUMENTS, "4,470,796 4/1988 Endo et al." should read --4,740,796 4/1988 Endo et al.--.

Column 1

Line 18, "systems" (both occurrences) should read --systems,--,

Line 19, "systems" (first occurrence) should read --systems,--,

Column 2

Line 27, "can" should read --can be--.

Column 4

Line 52, "is" should read --it--.

Column 7

Line 48, "synchronous" should read --synchronism--.

Column 10

Line 1, "synchronous" should read --synchronism--.

Column 11

Line 27, "synchronous" should read --synchronism--,

Line 55, "synchronous" should read --synchronism--.

Column 13

Line 4, "synchronous" should read --synchronism--.

Column 15

Line 51, "rotatin" should read --rotation--.

UNITED STATES PATENT AND TRADEMARK OFFICE

CERTIFICATE OF CORRECTION

PATENT NO. : 5,238,235

DATED : August 24, 1993

INVENTOR(S) : Tetsuhiro NITTA, et al.

It is certified that error appears in the above-indentified patent and that said Letters Patent is hereby corrected as shown below:

Column 16

Line 36, "mechanisms" should read --mechanism--,

Line 65, "is" should read --are--.

Column 22

Line 14, "angle 8" should read --angle B--.

Column 23

Line 6, "hight" should read --height--.

Signed and Sealed this

Thirteenth Day of September, 1994

Bruce Lehman

*Attest:*

BRUCE LEHMAN

*Attesting Officer*

*Commissioner of Patents and Trademarks*